US005282452A

United States Patent [19]

Urushiwara et al.

[11] Patent Number: 5,282,452

[45] Date of Patent: Feb. 1, 1994

[54] ELECTRONIC DISTRIBUTOR

[75] Inventors: Noriyoshi Urushiwara, Katsuta; Noboru Sugiura, Mito; Norio Moriyama, Ibaraki, all of Japan

[73] Assignee: Hitachi, Ltd., Tokyo, Japan

[21] Appl. No.: 963,764

[22] Filed: Oct. 20, 1992

[30] Foreign Application Priority Data

Oct. 25, 1991 [JP] Japan ..... 3-279179
Feb. 27, 1992 [JP] Japan ..... 4-040952

[51] Int. Cl.[5] ..... F02P 7/06

[52] U.S. Cl. ..... 123/643; 123/644

[58] Field of Search ..... 123/643, 644, 652, 609; 315/224

[56] References Cited

U.S. PATENT DOCUMENTS 4,708,121 11/1987 Everett et al. ..... 123/643
4,886,036 12/1989 Johansson et al. ..... 123/643 X
5,009,213 4/1991 Di Nunzio et al. ..... 123/643 X
5,113,840 5/1992 Taruya et al. ..... 123/644
5,115,793 5/1992 Giaccardi et al. ..... 123/644 X
5,146,907 9/1992 Sawazaki et al. ..... 123/644
5,199,406 4/1993 Taruya et al. ..... 123/644

FOREIGN PATENT DOCUMENTS 1-259550 10/1989 Japan .

*Primary Examiner*—Willis R. Wolfe
*Attorney, Agent, or Firm*—Evenson McKeown Edwards & Lenahan

[57] ABSTRACT

An electronic distributor for an internal combustion engine, having a plurality of switching elements for conducting and breaking currents flowing to a plurality of ignition coils, a first lead frame for separately flowing the currents of the plurality of switching elements to the plurality of ignition coils and a second single lead frame for dropping current levels of currents of at least two switching elements of the plurality of switching elements to a common electric potential, characterized in that a resistance value of the first lead frames has been set to be larger than a resistance value of the second lead frame.

23 Claims, 21 Drawing Sheets

ELECTRONIC DISTRIBUTOR

BACKGROUND OF THE INVENTION

The present invention relates to a load-controlling electronic device for controlling a current which flows through an electrical load, an igniting unit for an internal combustion engine for generating a high voltage and applying it to an ignition plug, an electronic distributor for an internal combustion engine for distributing a high voltage to an ignition plug of each cylinder, and an ignition timing control unit for an internal combustion engine for controlling the timing of an ignition to a mixed gas to be supplied to an internal combustion engine.

Recently, there have been an increasing number of devices according to which an ignition coil is disposed in each of a plurality of cylinders of an internal combustion engine and a switching element such as a power transistor or the like is disposed corresponding to each of the ignition coils. With this arrangement, it is possible to distribute a high voltage generated by an ignition coil to a specific cylinder by conducting and breaking a current to a specified switching element among a plurality of switching elements.

The connection of individual switching elements to separate ignition coils is done by separate lead frames. In other words, lead frames (lead frames at the ignition coils) of the number, at least the same as the number, of the switching elements are used to electrically connect the ignition coils with the switching elements. Further, the switching elements are connected to the common earth. In this case, the respective switching elements are connected to a common lead frame (a lead frame at the earth side) and then are connected to the earth. The above technique is disclosed in the JP-A-H 1-259550, for example.

A switching element for a transistor or the like is destroyed when an excess current is flown to the switching element. Therefore, a current limiting circuit is provided to limit the current flown to the switching element. The current limiting circuit detects a current which has flown to the switching element and limits the current when a current level of the current flowing to the switching element exceeds a predetermined level.

The current limiting circuit generally detects a current flowing to the switching element by a current detecting resistor. The current detecting resistor occupies a large area in a circuit substrate, and therefore, the current detecting resistor is used commonly. Under this system, a common current detecting resistor is connected to a plurality of switching elements. When a current flowing through this common current resistor exceeds a predetermined level, the current flowing to all the switching elements is limited simultaneously.

When one of the switching elements has been sticked due to an occurrence of a certain abnormal condition and this switching element has been fixed to a conductive state, an excess current flows to the lead frame at the ignition coil side and the lead frame at the earth side. According to the prior-art technique, one end of each switching element is connected to the ignition coil by the lead frame at the ignition coil provided corresponding to each switching element. The other end of each switching element is collected together with the other end of the rest of the switching elements, and they are earthed by a common lead frame at the earth. When the lead frame at the earth side has been sticked by an excess current, supply of a current to all the ignition coils is stopped. In this case, a supply of a current is stopped not only to the ignition coil connected to the abnormal switching element but also to other ignition coils connected to the switching elements which operate normally.

SUMMARY OF THE INVENTION

It is a first object of the present invention to make it possible to control the current flowing through all other ignition coils connected to other switching elements which function normally, even if one of a plurality of switching elements has been-fixed to a conductive state.

According to the prior-art technique, a current limiting circuit is provided to limit the current flowing to the switching element. When this current limiting circuit has come not to function for some reason, the switching element is sticked, with a result that, in many cases, the switching element is fixed to a conductive state. In this case, an excess current is supplied to the ignition coil and the ignition coil is heated, with a result that the ignition coil is burnt down in the worst case.

It is a second object of the present invention to make it possible to restrict the heating of an ignition coil by preventing an excess current from flowing to the ignition coil, even if a current limiting circuit has come not to function satisfactorily.

Further, according to the above-described prior-art technique, a current detecting resistor is used in common, and when a current flowing through this common current detecting resistor has become a predetermined level or above, the current flowing to the switching elements connected to the common current detecting resistor is uniformly limited. Therefore, when a current flowing to one switching element out of a plurality of switching elements has exceeded a predetermined level for some reason, the current flowing to all the switching elements connected to the common current detecting resistor, including other switching elements which can function normally, is limited. As described above, according to the prior-art technique, since the current detecting resistor is used in common, when a current of a predetermined level or above has flown to one of the switching elements, the functions of all the other switching elements are stopped, so that it becomes not possible to control the current which flows to the ignition coils connected to these switching elements.

It is a third object of the present invention to make it possible to control the current flowing to the ignition coils connected to other switching elements, even if the current flowing to one of the switching elements connected to a common current detecting resistor has become a predetermined level or above.

In order to achieve the above-described first object of the present invention, a first configuration includes a plurality of switching elements for separately conducting and breaking currents flowing to a plurality of ignition coils, respectively, a plurality of first lead frames for separately flowing currents of the plurality of switching elements to the plurality of ignition coils respectively, and a single second lead frame for dropping the current levels of currents of at least two switching elements out of the plurality of switching elements to a common potential, and a resistance value of the first lead frames is set to be higher than a resistance value of the second lead frame.

Further, in order to achieve the above first object of the present invention, a second configuration includes a plurality of switching elements for separately conducting and breaking currents flowing to a plurality of ignition coils respectively, a plurality of first lead frames for separately flowing currents of the plurality of switching elements to the plurality of ignition coils respectively, and a single second lead frame for dropping the current levels of currents of at least two switching elements out of the plurality of switching elements to a common potential, and a temperature coefficient of a specific resistivity of the first lead frames is set to be larger than a temperature coefficient of a specific resistivity of the second lead frame.

Further, in order to achieve the above first object of the present invention, a third configuration includes a plurality of switching elements for separately conducting and breaking currents flowing to a plurality of ignition coils respectively, a plurality of first lead frames for separately flowing currents of the plurality of switching elements to the plurality of ignition coils respectively, and a single second lead frame for dropping the current levels of currents of at least two switching elements out of the plurality of switching elements to a common potential, and a melting point of the first lead frames is set to be lower than a melting point of the second lead frame.

Further, in order to achieve the above first object of the present invention, a fourth configuration includes a plurality of switching elements for separately conducting and breaking currents flowing to a plurality of ignition coils respectively, a plurality of first lead frames for separately flowing currents of the plurality of switching elements to the plurality of ignition coils respectively, and a single second lead frame for dropping the current levels of currents of at least two switching elements out of the plurality of switching elements to a common potential, and at least one of both ends of each of the first lead frames is connected by solder and the solder is melted to release an electrical connection when a current flowing to each of the first lead frames has become a predetermined level or above.

In order to achieve the above-described second object of the present invention, a fifth configuration includes a plurality of switching elements for separately conducting and breaking currents flowing to a plurality of ignition coils respectively, a first current limiting unit for limiting a current flowing to each of the switching elements when the current flowing to each of the switching elements has become larger than a predetermined value, and a second current limiting unit for limiting a current flowing to the switching element when a current of a second predetermined value larger than the first predetermined value has flown to the switching element. The second current limiting unit backs up the first current limiting unit.

In order to achieve the above-described third object of the present invention, a sixth configuration includes a plurality of switching elements for separately conducting and breaking currents flowing to a plurality of ignition coils respectively, a common current detecting resistor into which a current which flows to the plurality of switching elements flows, and a current limiting circuit for simultaneously breaking currents which flow to the plurality of switching elements when the current flowing to the current detecting resistor has exceeded a predetermined value, and a resistance value of a conductor (for example, a pattern on the substrate) for electrically connecting the ignition coils with the current detecting resistor is set to be higher than a resistance value of a conductor (for example, a pattern on the substrate) for electrically connecting the current detecting resistor with the earth.

A current from the battery flows to the ignition coils, the lead frames at the ignition coil side, the switching elements, the lead frame at the earth side and the earth, in this order. According to the first configuration, when one of the switching elements has been fixed to a conductive state, an excess current flows to the lead frame at the earth side through the lead frame at the ignition coil side. However, since the resistance value of the lead frame at the ignition coil side has been set to be higher than the resistance value of the lead frame at the earth side, the calorific value of the lead frame at the ignition coil becomes larger than the calorific value of the lead frame at the earth side. Therefore, the lead frame at the ignition coil side connected to the switching element that has become in an abnormal state is fused earlier than the lead frame at the earth side. Accordingly, the excess current from the ignition coil is not supplied to the lead frame at the earth side, and the lead frame at the earth side is released from being fused by the excess current. As a result, it becomes possible to control the current of at least the ignition coils which are connected to the other switching elements that function normally.

According to the second configuration, when one of the switching elements has been fixed to a conductive state, an excess current flows to the lead frame at the earth side through the lead frame at the ignition coil side. However, since the temperature coefficient of the specific resistivity of the lead frame at the ignition coil side has been set to be larger than the temperature coefficient of the specific resistivity of the lead frame at the earth side, the change of resistance due to the rise in temperature is higher for the lead frame at the ignition side than for the lead frame at the earth side. Therefore, when the temperatures of the lead frames have risen due to the flow of an excess current, the resistance value of the lead frame at the ignition coil side becomes higher than the resistance value of the lead frame at the earth side. Accordingly, the calorific value of the lead frame at the ignition coil side becomes larger than the calorific value of the lead frame at the earth side. As a result, the lead frame at the ignition coil side connected to the switching element in an abnormal state is fused earlier than the lead frame at the earth side. Thus, the excess current from the ignition coil is not supplied to the lead frame at the earth side any more, so that it becomes possible to control the current of at least the ignition coils which are connected to the other switching elements that function normally.

According to the third configuration, the melting point of the lead frame at the ignition coil side has been set to be lower than the melting point of the lead frame at the earth side. Therefore, when the temperatures of the lead frames have risen due to the flow of an excess current, the lead frame at the ignition coil side is melted earlier and its electrical connection is released earlier than the lead frame at the earth side. Accordingly, the lead frame at the ignition coil side connected to the switching element that became in an abnormal state is broken earlier than the lead frame at the earth side. Thus, the excess current from the ignition coil is not supplied to the lead frame at the earth side any more, so that it becomes possible to control the current of at least the ignition coils connected to the other switching elements that function normally.

According to the fourth configuration, at least one of the connections at both ends of the lead frame at the ignition coil side is done by using solder, and the solder is melted to release an electrical connection of the lead frame at the ignition coil side when the current flowing through this lead frame has exceeded a predetermined level. Therefore, when the temperatures of the lead frames have risen due to a flow of an excess current, the lead frame at the ignition coil side connected to the switching element that became in an abnormal state is melted. Accordingly, the excess current from the ignition coil is not supplied to the lead frame at the earth side any more, so that it becomes possible to control the current of at least the ignition coils which are connected to the other switching elements that function normally.

According to the fifth configuration, even if the first current limiting circuit has come not to function any more, the second current limiting circuit functions to prevent an excess current. Therefore, it becomes possible to prevent an excess current from flowing into the ignition coils, thus restricting a heating of the ignition coils.

A current from the battery flows through various parts in the order of the ignition coil, the switching element, the current detecting resistor and the earth. According to the sixth configuration, the resistance value of the conductor for electrically connecting between the ignition coil and the current detecting resistor is set to be higher than the resistance value of the conductor for electrically connecting between the current detecting resistor and the earth. Accordingly, the calorific value of the conductor for electrically connecting between the current detecting resistor and the earth becomes higher than the calorific value of the conductor for electrically connecting between the current detecting resistor and the earth, so that the conductor for electrically connecting between the current detecting resistor and the earth is melted earlier. As a result, a current is not supplied any more from the switching element which became in an abnormal state to the common current detecting resistor, and it becomes possible to control the current which flows to the ignition coils connected to the other switching elements that function normally.

DESCRIPTION OF THE PREFERRED EMBODIMENTS

Figure 2:
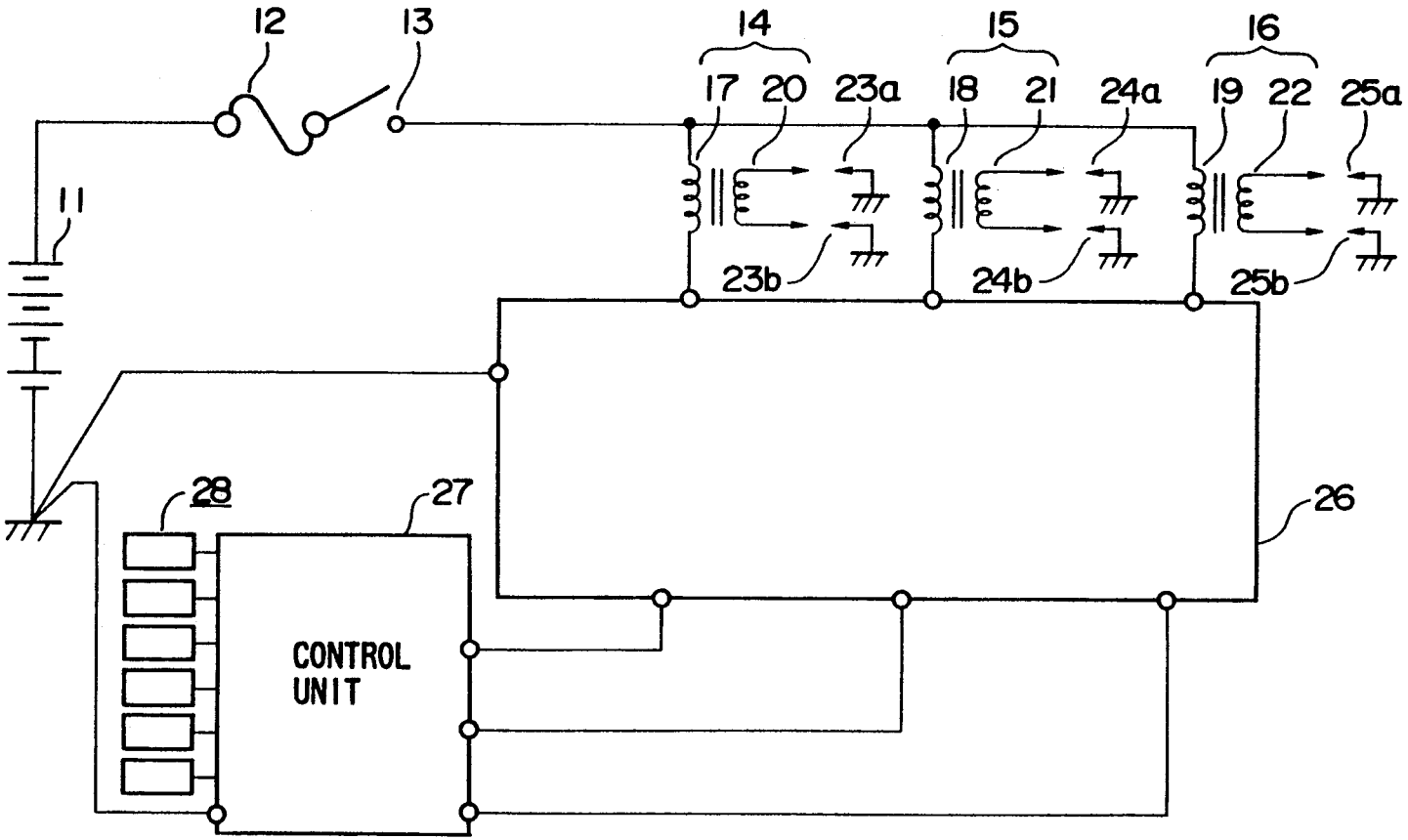
FIG. 2 is a block diagram for showing the configuration of the system in the above embodiment.

Embodiments of the present invention will be explained below with reference to the drawings. FIG. 2 is a system configuration diagram for showing the configuration of the so-called six-cylinder simultaneous firing system. The voltage of a battery 11 is applied to one end of primary coils 17 to 19 of ignition coils 14 to 16 through a fuse 12 and a switch 13. Meanwhile, outputs of a group of sensors 28 (such as an air intake quantity sensor, a crank angle sensor, etc.) which detect physical quantities for showing the operating state of the internal combustion engine such as the air intake quantity and the engine rotation number, are supplied to a control unit 27. The control unit 27 calculates the ignition timing based on the outputs of the sensors 28 and outputs a signal to a power module 26. In this case, the signal to be outputted from the control unit 27 is about several mA to several 10 mA. The power module 26 operates to supply a current from the battery 11 to specific ignition coils (17 to 19) when the control unit 27 has made an output of high. In this case, a current of several A is supplied to the primary coils (17 to 19) of the ignition coils. The current to be supplied to the primary coils (17 to 19) of the ignition coils (14 to 16) is limited to a predetermined current value or below by a current limiting circuit 64, as described later.

The power module 26 also operates to break the current from the battery 11 to the primary coils (17 to 19) of the specific ignition coils (14 to 16) when the control unit 27 has made an output of low. When the current which has been supplied so far is broken momentarily, a high voltage occurs in secondary coils (20 to 22) of the ignition coils (14 to 16), and a spark flies to ignition plugs (23*a*, 23*b* to 25*a*, 25*b*).

Figure 3:
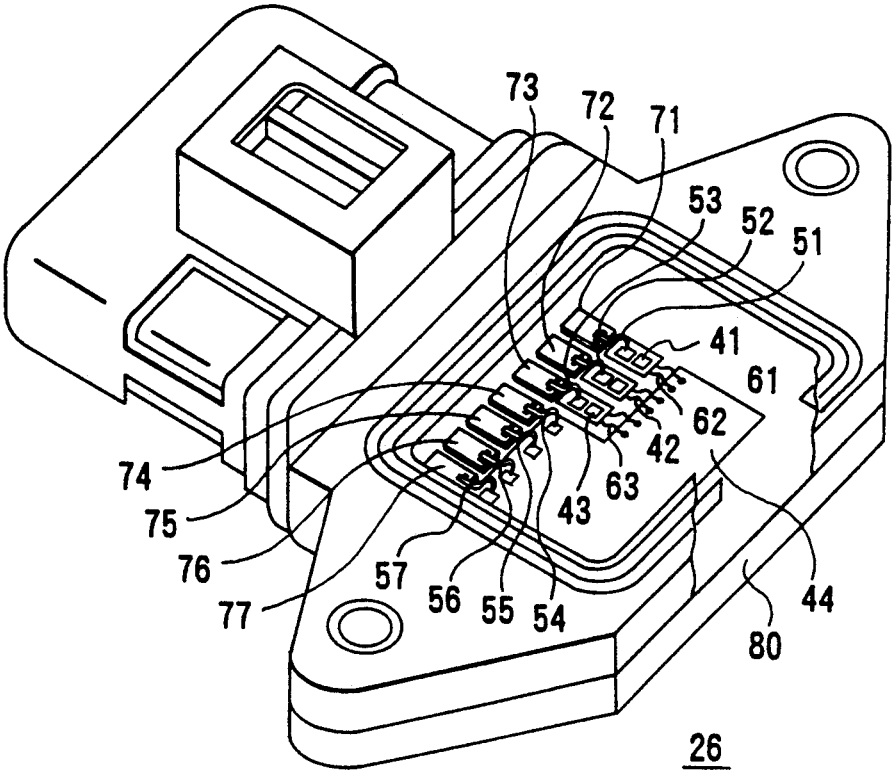
FIG. 3 is a perspective diagram for showing the details of the power module.

Details of the power module 26 will be explained next. In FIG. 3, package terminals 71 to 77 are molded in an external case 80. One end of each of the package terminals 71 to 73 is connected to the ignition coils 14 to 16 respectively through a connector which is mountable and dismountable to and from the external case 80. The other end of each of the package terminals 71 to 73 is connected to power transistors 41 to 43 respectively through lead frames 51 to 53 (the lead frames at the ignition coil side). The lead frames hereinafter include not only the plane shaped type, but also all the types of cross sections, including the so-called lead wire which has a disk-shaped cross section. The power transistors 41 to 43 are connected on to a hybrid IC substrate 44 through lead frames 61 to 63. It is suitable that a material of a relatively small resistance value such as aluminum, copper or pyrites is used for the lead frames 61 to 63. A MOS type FET can also be used instead of the power transistors 41 to 43. Further, it is needless to mention that all the other semiconductor switching elements can be used. One end of each of package terminals 74 to 76 is connected to a control unit 27 through lead frames 54 to 56 and one end of a package terminal 77 is connected to the earth through a lead frame 57 (the lead frame at the earth side). The other side of each of the package terminals 74 to 77 is connected to a hybrid IC substrate 44.

Figure 4:
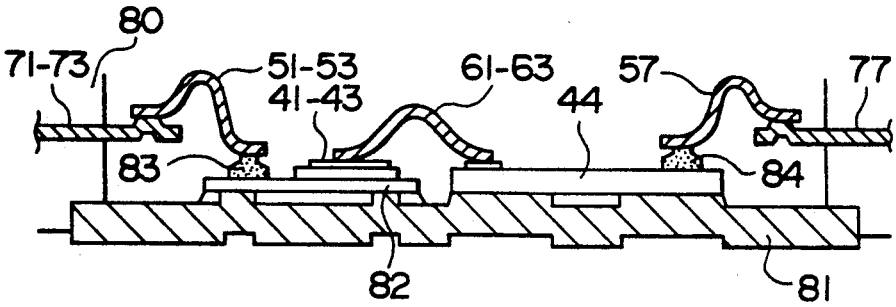
FIG. 4 is a schematic cross sectional diagram for showing the details of the connection of the circuits within the power module.

The connection state of the internal circuits of the power module 26 will be explained next. Referring to FIG. 4, the package terminals 71 to 73 are welded to one end of the lead frames 51 to 53 (the lead frames at the ignition coil side) respectively. The other end of each of the lead frames 51 to 53 is welded to a ceramic substrate 82 through a welding pad 83. On the ceramic substrate 82, the power transistors 41 to 43 are formed to be electrically connected to the lead frames 51 to 53. The power transistors 41 to 43 are connected to the hybrid IC substrate 44 through the lead frames 61 to 63 (structured by a material such as aluminum or copper). The hybrid IC substrate 44 is structured on a metal base 81 through an insulating material (not shown). One end of the package terminal 77 is welded to one end of the lead frame 57 (the lead frame at the earth side). The other end of the lead frame 57 is welded to the hybrid IC substrate 44 through a welding pad 84. Thus,.the hybrid IC substrate 44 is electrically connected to the package terminal 77.

Figure 1:
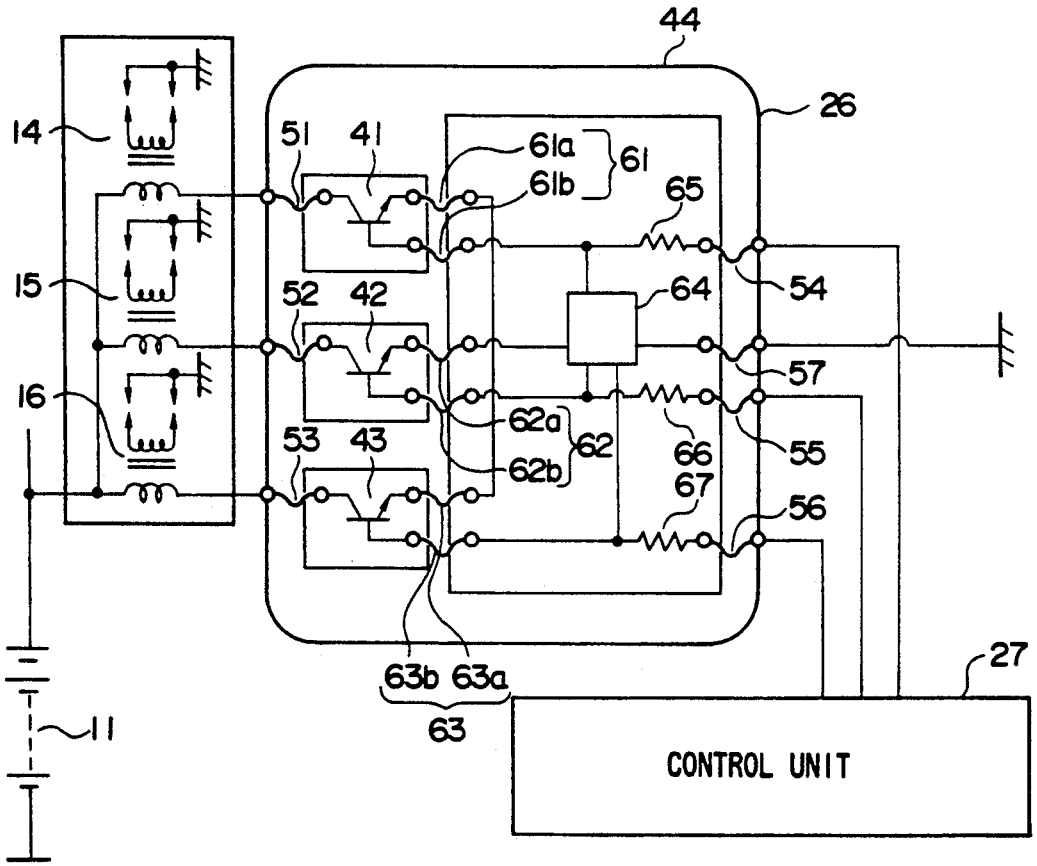
FIG. 1 is a block diagram for showing the details of the power module of the electronic distributor according to one embodiment of the present invention.

The circuit structure inside the power module 26 will be explained next. Referring to FIG. 1, the ignition coils 14 to 16 are connected to the collectors of the power transistors 41 to 43 respectively. The emitters of the power transistors 41 to 43 are connected to the current limiting circuit 64 and are then connected to the earth through the lead frame 57. On the other hand, the base of each of the power transistors 41 to 56 through resistors 65 to 67 respectively, and is then connected to the control unit 27.

Assume the relationship between resistance values R1 to R3 of the lead frames 51 to 53 and a resistance value R4 of the lead frame 57 as follows:

$$R4 < R1 \sim R3$$

When a nickel wire is used for the material of the lead frames, for example, the following resistance values can be obtained:

$$R1 \sim R3 \approx 15\ m\Omega$$

$$R4 \approx 10\ m\Omega$$

In order to obtain these resistance values, a material of Fe - Ni system may also be used. In order to have the resistance values R1 to R3 of the lead frames 51 to 53 to be larger than the resistance value R4 of the lead frame 57, the length of the lead frames 51 to 53 may be set to be larger than the length of the lead frame 57. Alternatively, the diameter of the lead frames 51 to 53 may be set smaller than that of the lead frame 57 to have a larger resistance value. It is of course possible to have the resistance values R1 to R3 of the lead frames 51 to 53 to be larger than the resistance value R4 of the lead frame 57 by changing the material of the lead frames. For example, a material of Ni or Ni - Fe system may be used for the lead frames 51 to 53 and aluminum, copper or pyrites may be used for the lead frame 57.

The operation of the power module 26 will be explained below. When all the power transistors 41 to 43 are in a normally operating state and when a signal from the control unit 27 is at a low level, current (primary current) does not flow to the primary coils 17 to 19 of the ignition coils 14 to 16 because the power transistors 41 to 43 are in a cut-off state. However, when one of the power transistors 41 to 43 has been short circuited and broken for some reason, a current continuously flows to the primary coils of the ignition coils regardless of the level of the signal from the control unit 27. In this case, the current flows in the order of ① the battery 11, ② the primary coils 17 to 19, ③ the lead frames 51 to 53, ④ between the collectors and the emitters of the power transistors 41 to 43, ⑤ the lead frames 61*a* to 63*a*, ⑥ the hybrid IC 44, ⑦ the lead frame 57 and ⑧ the earth. If such an abnormal continuous current conduction lasts, the ignition coils 14 to 16 are heated, and the coils start generating smokes and fire in the worst case. In order to prevent smoking and firing, any one of the wirings of ③, ⑤ and ⑦ is set to an open state. However, when the wiring of ⑦ is set to an open state, all the other normal circuits cease to operate so that the operation of the engine becomes impossible. Generally, the wiring of ⑤ uses a very short aluminum line or a copper line, for example. Therefore, even if an excess current flows to this wiring, the calorific value due to the excess current is so small that the wiring is hardly burnt down to be disconnected. When the wiring of ③ is set in an open state, no current flows from the short-circuited power transistor, so that smoking and firing of the coils can be prevented and a fail-safe mechanism in which the operation of the engine is possible can be realized. In this case, it is possible to minimize the cost when the lead frames 51 to 53 for connecting between the package terminals 71 to 73, provided in the package for sealing the circuits of the ignition circuit, and the collectors of the power transistors 41 to 43, are operated like fuses. For this purpose, the resistance values of the package terminals 71 to 73 and the lead frames 51 to 53 are set to a value, larger than the resistance values of the other wirings, at which the coils are fused under a specific condition.

With the above-described arrangement, even if one of the power transistors 41 to 43 has been short circuited, an excess current flows to the ignition coils and the lead frames in such a way that only the lead frame connected to the short-circuited power transistor (that is, one of the lead frames 51 to 53) is excessively heated due to the excess current and only this lead frame is fused by the heating. It is good to design such that the lead frames 51 to 53 are fused when a current of about 10 A has flown to the lead frames 51 to 53.

Thus, the following sequence of operation occurs. One of the power transistors 41 to 43 is short-circuited→an excess current flows→one of the lead frames 51 to 53 is fused→the excess current stops→ignition is continued by the other power transistors. Even if a power transistor has been short-circuited and then broken due to a fault of the element or the like, the lead frame at the collector side of the short-circuited power transistor is fused immediately and no excess current flows to the ignition coils 14 to 16 and the hybrid IC substrate 44. The ignition operation becomes possible by enabling a normal ignition operation by the rest of the cylinders. Since a continuous flow of an excess current to the ignition coils is prevented, it is also possible to prevent smoking and firing of the ignition coils.

Figure 5:
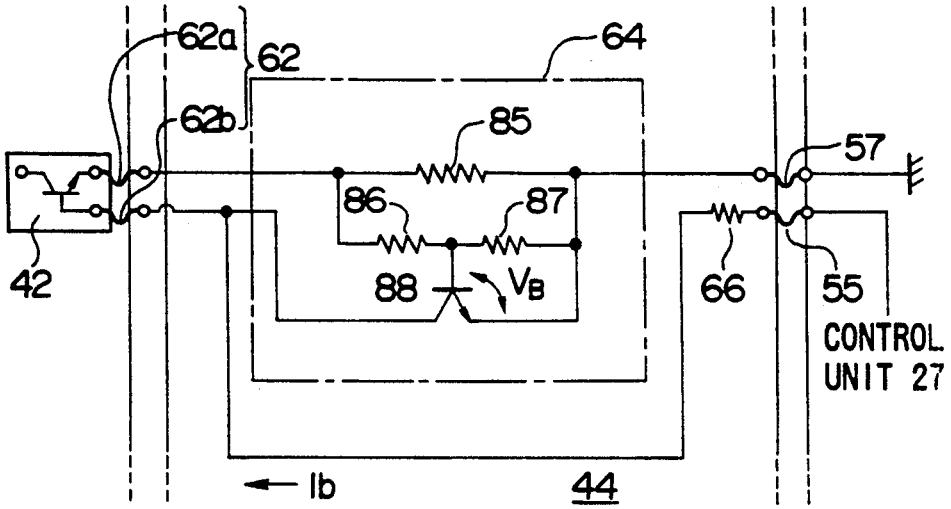
FIG. 5 is a diagram for showing one embodiment of the current limiting circuit in the above-described embodiment.

Details of the current limiting circuit 64 will be explained next. Referring to FIG. 5, the emitter of the power transistor 41, the emitter of the power transistor 42 and the emitter of the power transistor 43 are connected together to one end of a current limiting resistor 85. The other end of the current limiting resistor 85 is connected to the earth. Between the emitter and the earth of each of the power transistors 41 to 43, resistors 86 and 87 are connected in parallel with the current detecting resistor 85. The base of the power transistor 41, the base of the power transistor 42 and the base of the power transistor 43 are connected together to the collector of a transistor 88. The emitter of the transistor 88 is connected to the earth. The base of the transistor 88 is connected to a junction point between resistors 86 and 87. The base of each of the power transistors 41 to 43 is also connected to the control unit 27.

The operation of the current limiting circuit 64 will be explained. When a current $I_b$ flows from the control unit 27, the transistor 42 (transistors 41 and 43) is rendered conductive. When the transistor 42 (transistors 41 and 43) has been set to a conductive state, the voltage between the collector and the emitter of the transistor 42 (transistors 41 and 43) gradually rises. This voltage is detected by the current detecting resistor 85 and is then divided by the resistors 86 and 87. When the value of this divided voltage exceeds a threshold level $V_b$ (about 0.7 V), the transistor 88 is rendered conductive, to thereby connect between the base of the power transistor 42 and the earth. Thus, the transistor 42 is set to a cut-off state.

Since the emitter of each of the power transistors 41 to 43 is connected to the current limiting resistor 85 which is being used commonly, when the current of any one of power transistors 41 to 43 exceeds the threshold level $V_b$ and the transistor 88 is rendered conductive, the base of each of the power transistors 41 to 43 is connected to the earth. In other words, when the current of any one of the power transistors 41 to 43 has reached a level above A predetermined level, all the power transistors 41 to 43 are set to a cut-off state.

When any one of the power transistors 41 to 43 has been short-circuited to have become always in a conductive state, for example, a current equal to or higher than a predetermined level of current always flows to the current detecting resistor 85, and therefore the current limiting circuit 64 operates to set all the power transistors 41 to 43 to a cut-off state. In this state, no current flows to any one of the ignition coils (14 to 16, so that it becomes impossible to fire a mixed gas to be supplied to the internal combustion engine. Thus, the internal combustion engine is placed in a position to completely stop its operation.

However, according to the present embodiment, as described above, when an excess current has flown to the power transistors 41 to 43, the lead frame (any one of the lead frames 51 to 53) corresponding to the power transistors (41 to 43) is burnt down. Therefore, a current is not supplied from the short-circuited power transistor (one of 41 to 43) to the current detecting resistor 85. The short-circuiting of one of the power transistors (41 to 43) does not interfere the operation of the rest of the normal power transistors (41 to 43).

As described above, according to the present embodiment, even if any one of the power transistors 41 to 43 has been short-circuited and broken, the connection between one of the lead frames 51 to 53, provided in the package for sealing the circuits of the power module 26, and the collector of any one of the power transistors 41 to 43, is forcedly fused to break. Therefore, smoking and firing of the ignition coils can be prevented and a fail-safe system is provided at a low cost which enables a self-running of a vehicle even though the vehicle running condition is not satisfactory, with such an effect that as if a second current limiting circuit were provided.

According to the present embodiment, the lead frame 57 at the earth side is used to connect between the emitter and the earth of each of the power transistors 41 to 43. However, instead of this method, it is also good to connect the emitter of each of the power transistors 41 to 43 to a metal base 81 through a current limiting circuit 64. For the connection between the current limiting circuit 64 and the metal base 81 to achieve the grounding, an aluminum wire may be used to connect the two by welding. According to the method for grounding by using the metal base 81, a were welding enables the grounding of the emitters of the power transistors 41 to 43. This method also power transistors 41 to-43. This method also facilitates the work and simplifies the whole configuration of the power module.

Figure 6A:
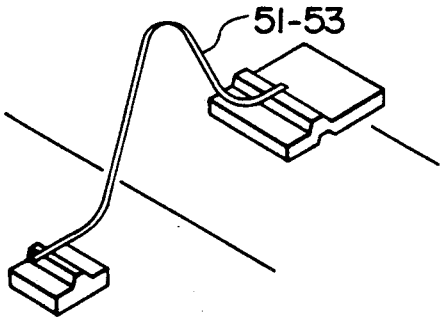
FIGS. 6(*a*) and (*b*) are perspective diagrams for showing another embodiments of the lead frame in the above-described embodiment.
Figure 6B:
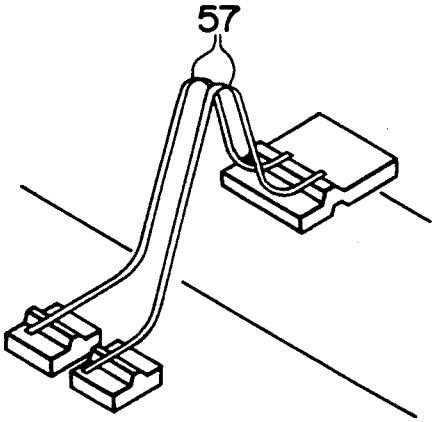

Another embodiment of the present invention will be explained below with reference to FIG. 6. According to this embodiment, a lead frame 57 shown in FIG. 6(*b*) is structured by parallel connecting two lead frames which are exactly the same as lead frames 51 to 53 in FIG. 6(*a*).

With the above arrangement, the lead frame at the ignition side has a higher resistance than the lead frame at the earth side.

Instead of adjusting the number of the lead frames, it is also possible to achieve the objects of the present invention by adjusting frames structured by the same material. In other words, with the same material, the lead frame having a larger length has a higher resistance, and also with the same material, the lead frame having a smaller cross section has a higher resistance, than the other lead frame, respectively.

Figure 7:
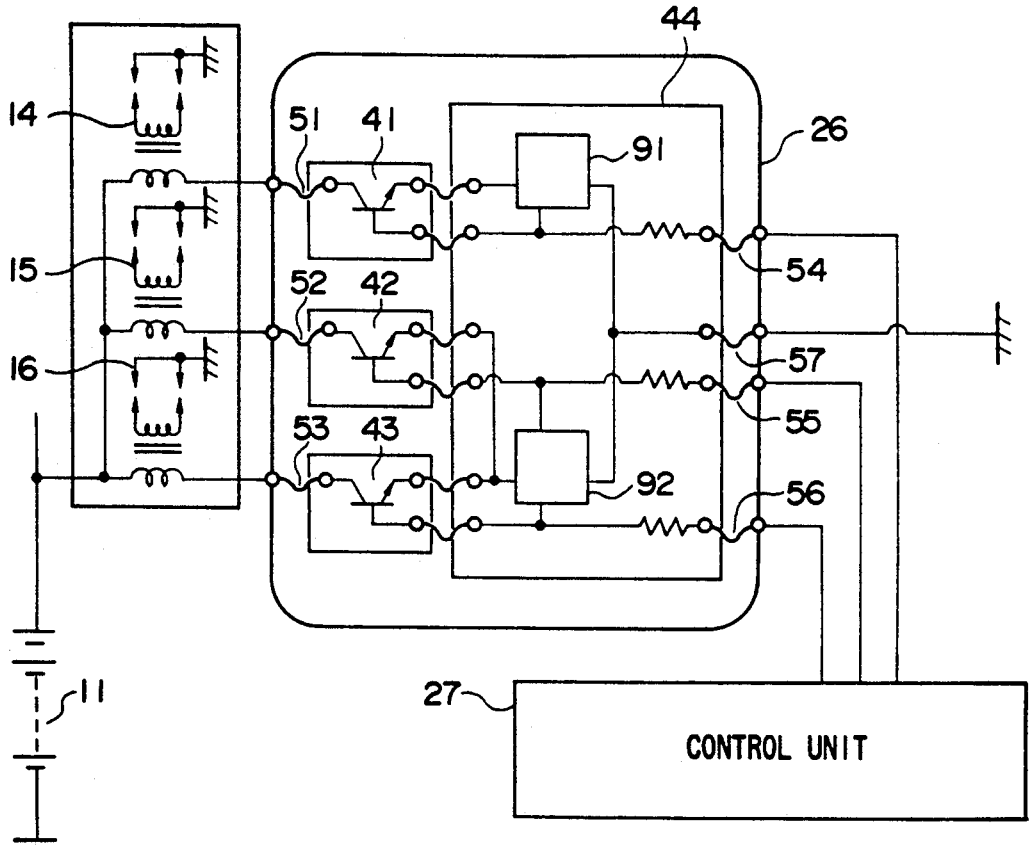
FIG. 7 is a diagram for showing an embodiment in which two current detecting portions are provided in a six-cylinder simultaneous firing system.

A still another embodiment of the present invention will be explained with reference to FIG. 7. According to this reference to FIG. 7. According to this embodiment, the collector and emitter current of the power transistor 41 is controlled by a current limiting circuit 91. Further, the collector and emitter current of the power transistor 42 and the power transistor 43, respectively, is controlled by a current limiting, respectively, is controlled by a current limiting circuit 92 (provided separately from currents flowing to the power transistors 41 to 43 are controlled by the two current limiting circuits 91 and 92 respectively. Accordingly, even if one of these current limiting circuits is placed in an abnormal state, the other current limiting circuit can operate normally.

Figure 8:
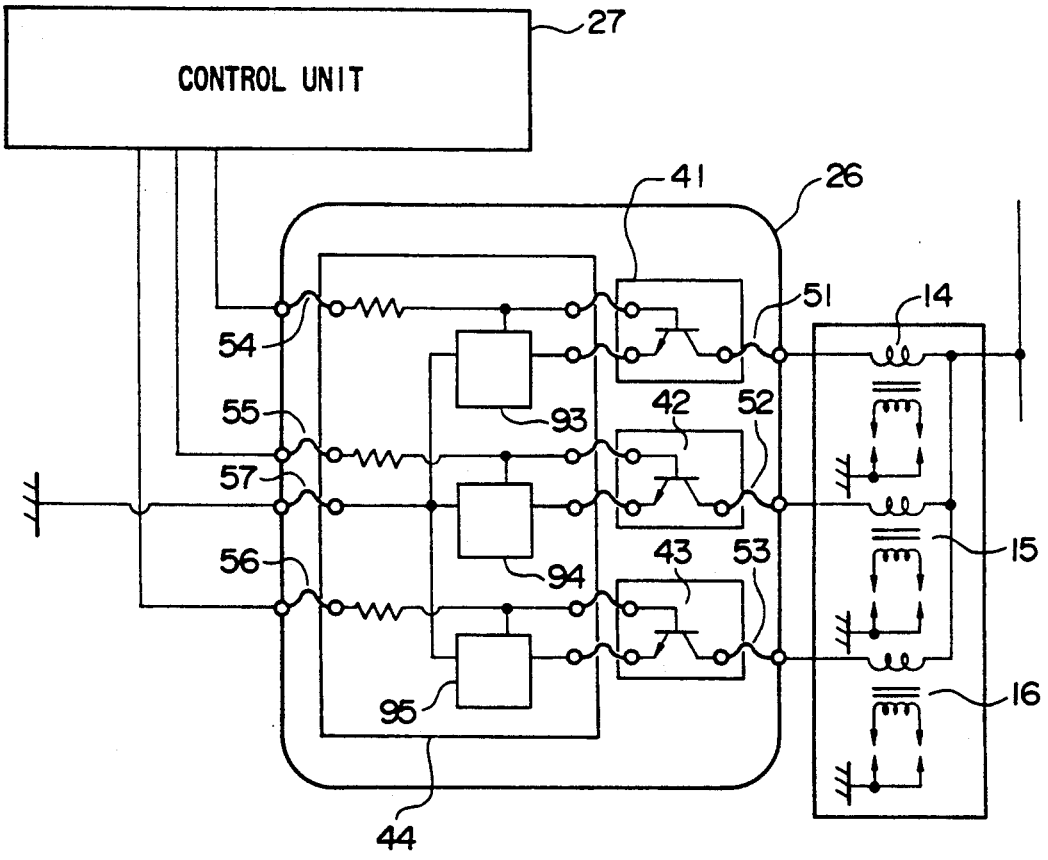
FIG. 8 is a diagram for showing an embodiment in which three current detecting portions are provided in a six-cylinder simultaneous firing system.

A still another embodiment of the present invention will be explained below with reference to FIG. 8. In this embodiment, the collector emitter current of the power transistor 41 is controlled by a current limiting circuit 93, the collector emitter current of the power transistor 42 is controlled by a current limiting circuit 94 and the collector emitter current of the power transistor 43 is controlled by a current limiting circuit 95. Since the currents flowing to the power transistors 41 to 43 are controlled by the current limiting circuits 93 to 95 respectively, even if one of the current limiting circuits 93 to 95 becomes in an abnormal state, the other current limiting circuits can operate normally.

Figure 9:
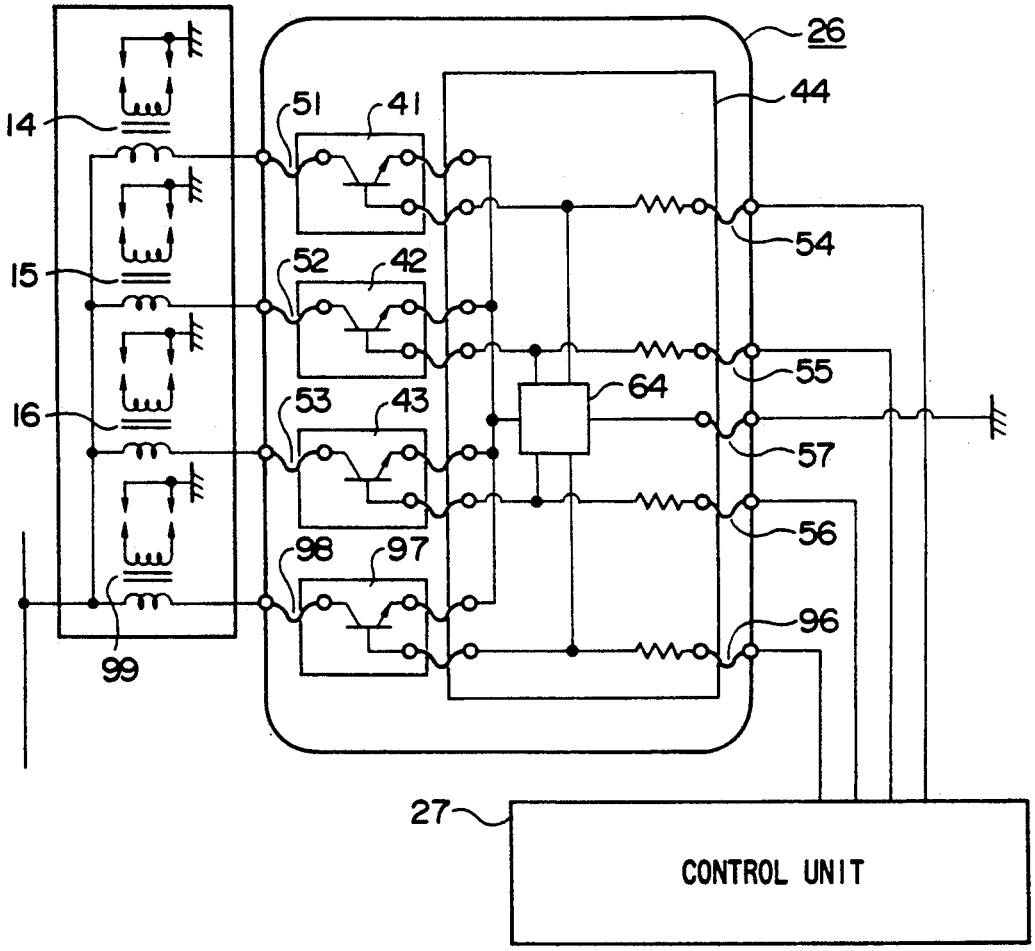
FIG. 9 is a diagram for showing an embodiment in which one current detecting portion is provided in an eight-cylinder simultaneous firing system.

A still another embodiment of the present invention will be explained with reference to FIG. 9. In this embodiment, a so-called eight-cylinder simultaneous firing system, having two ignition plugs connected to each of the four ignition coils 14, 15, 16 and is shown. The ignition coils 14, 15, 16 and 99 are connected to the power transistors 41, 42, 43 and 98 respectively. Further, the power transistors 41, 42, 43 and 97 are connected to the control unit 27 through the lead frames 54, 55, 56 and 96 respectively. The other portions are the same as those of the other embodiments, so that their description will be omitted here.

A still another embodiment of the present invention will be explained with reference to FIG. 10. In this embodiment, a so-called four-cylinder independent firing system, having one ignition plug connected to each of the four ignition plugs 14, 15, 16 and 99, is shown. The other portions are the same as those of the embodiment shown in FIG. 19.

Figure 11:
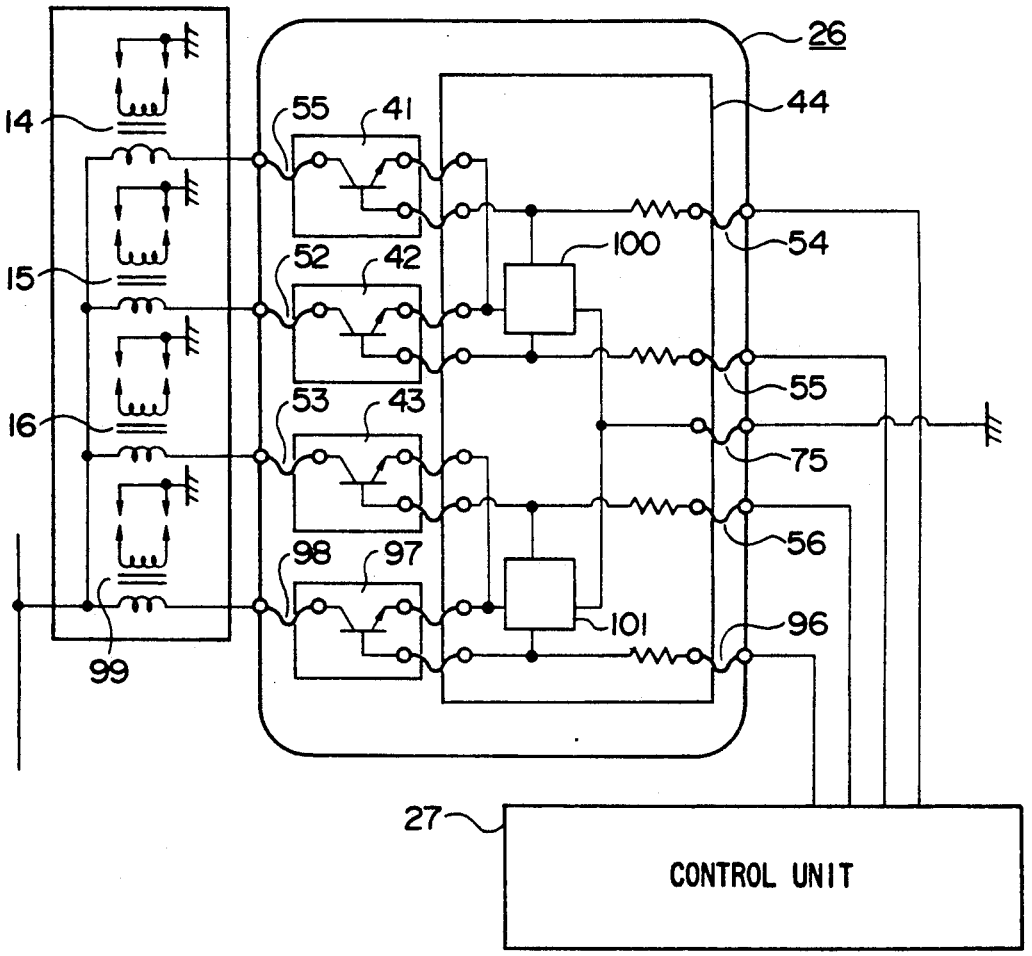
FIG. 11 is a diagram for showing an embodiment in which two current detecting portions are provided in an eight-cylinder simultaneous firing system.

A still another embodiment of the present invention will be explained with reference to FIG. 11. In this embodiment, the currents flowing to the power transistors 41 and 42 are controlled by a current limiting circuit 100 and the currents flowing to the power transistors 43 and 97 are controlled by a current limiting circuit 101. The other portions are the same as those of the embodiment shown in FIG. 9.

A still another embodiment of the present invention will be explained with reference to FIG. 12. In this embodiment, a so-called four-cylinder independent firing system, having one ignition plug connected to each of the four ignition coils 14, 15, 16 and 99, is shown. The other portions are the same as those of the embodiment shown in FIG. 11.

A still another embodiment of the present invention will be explained with reference to FIG. 13. In this embodiment, the currents flowing to the power transistors 41, 42, 43 and 97 are controlled by current limiting circuits 102, 103, 104 and 105 respectively. The other portions are the same as those of the embodiment shown in FIG. 12.

A still another embodiment of the present invention will be explained with reference to FIG. 14. In this embodiment, a so-called four-cylinder independent firing system, having one ignition plug connected to each of the four ignition coils 14, 15, 16 and 99, is shown. The other portions are the same as those of the embodiment shown in FIG. 13.

Figure 15:
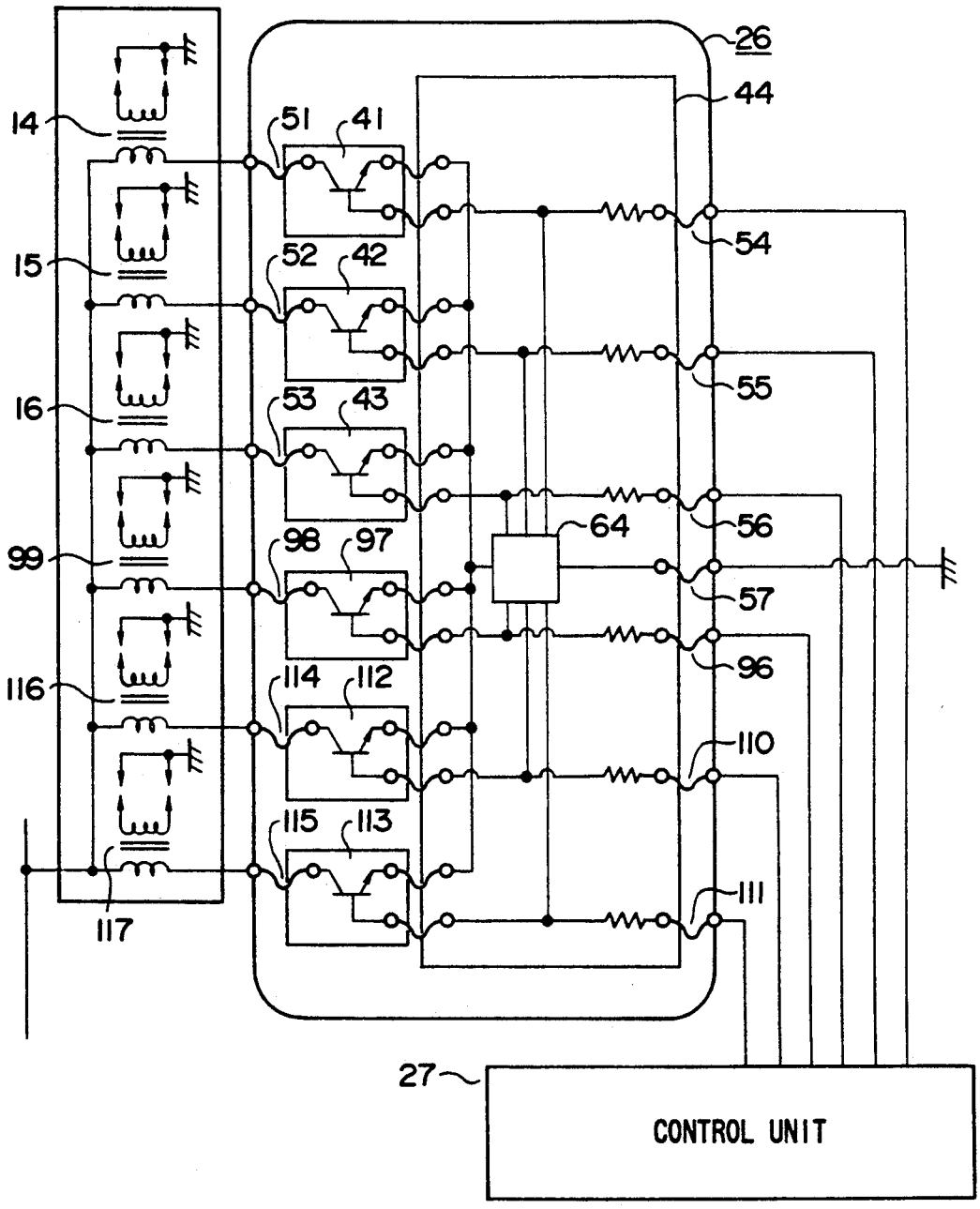
FIG. 15 is a diagram for showing an embodiment in which one current detecting portion is provided in a twelve-cylinder simultaneous firing system.

A still another embodiment of the present invention will be explained with reference to FIG. 15. In this embodiment, a so-called twelve-cylinder simultaneous firing system, having two ignition plugs connected to each of six ignition coils 14, 15, 16, 99, 116 and 117, is shown. The ignition coils 14, 15, 16, 99, 116 and 117 are connected to power transistors 41, 42, 43, 97, 112 and 113 through lead frames 51, 52, 53, 98, 114 and 115, respectively. The power transistors 41, 42, 43, 97, 112 and 113 are connected to the control unit 27 through lead frames 54, 55, 56, 110 and 111 respectively. The other portions are the same as those of the embodiment shown in FIG. 1.

Figure 16:
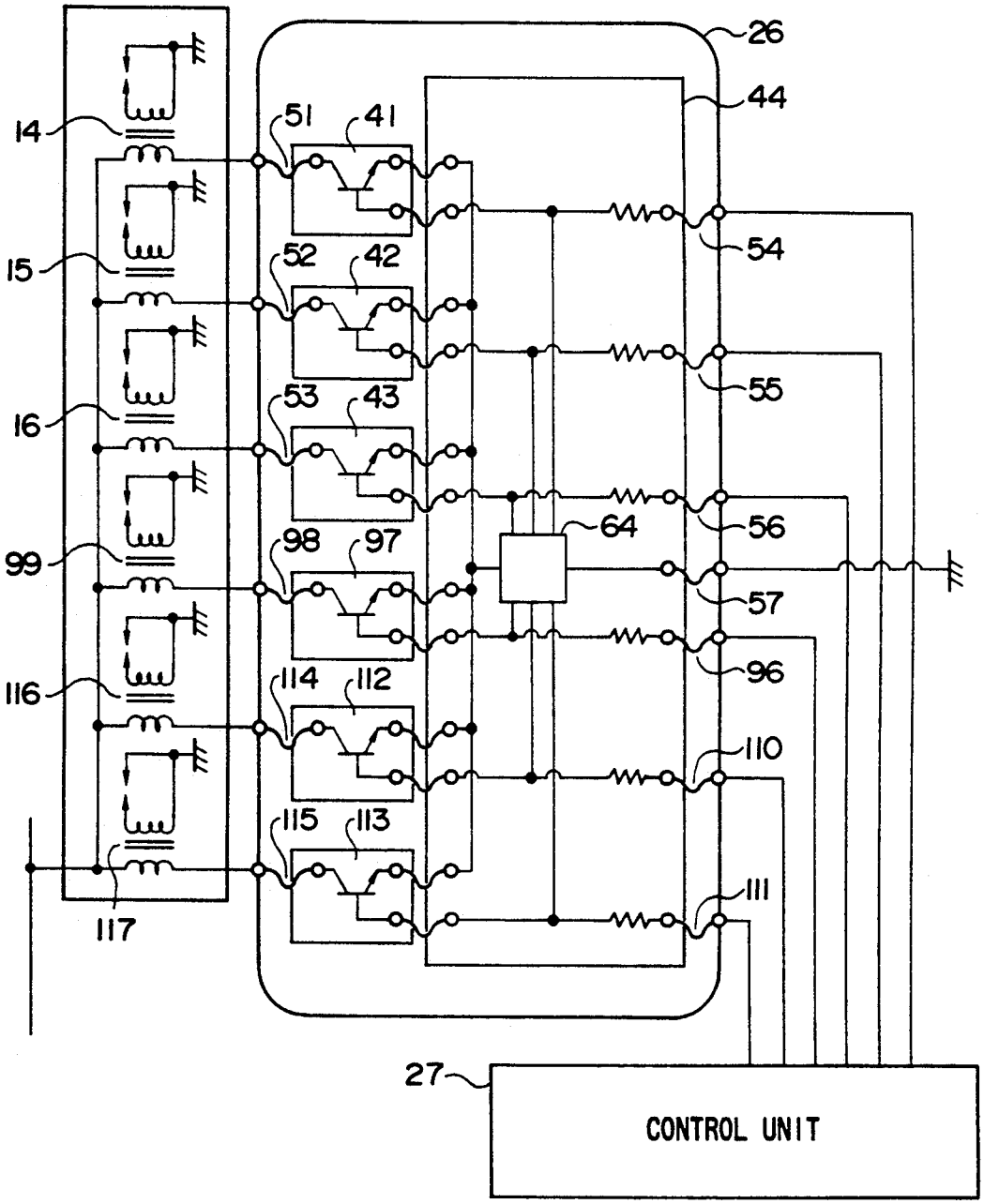
FIG. 16 is a diagram for showing an embodiment in which one current detecting portion is provided in a six-cylinder independent firing system.

A still another embodiment of the present invention will be explained with reference to FIG. 16. In this embodiment, a so-called six-cylinder independent firing system, having one ignition plug connected to each of the six ignition coils 14, 15, 16, 99, 116 and 117, is shown. The other portions are the same as those of the embodiment shown in FIG. 15.

Figure 17:
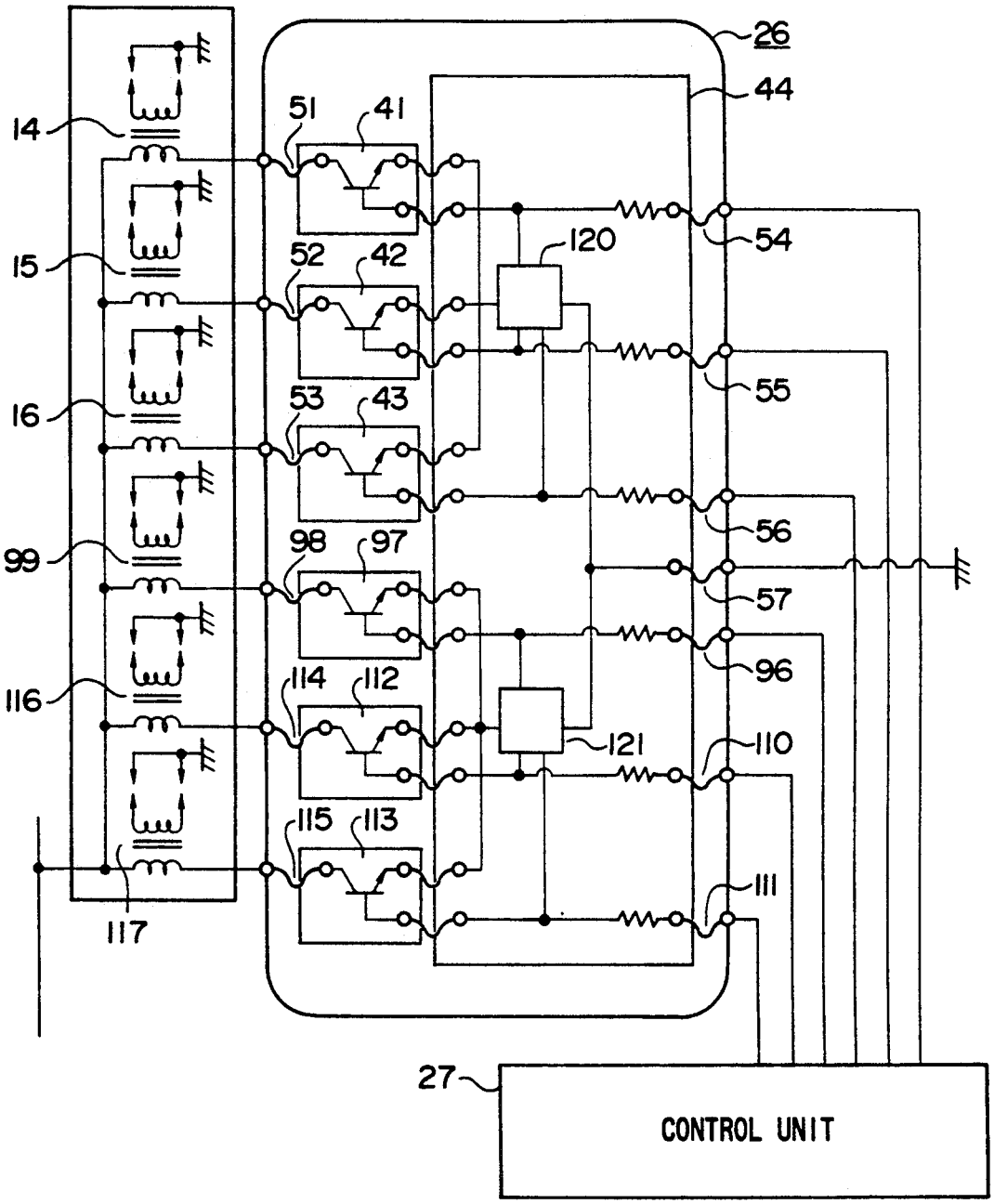
FIG. 17 is a diagram for showing an embodiment in which two current detecting portions are provided in a twelve-cylinder simultaneous firing system.

A still another embodiment of the present invention will be explained with reference to FIG. 17. In this embodiment, the currents flowing to the power transistors 41, 42 and 43 are controlled by a current limiting circuit 120 and the currents flowing to the power transistors 97, 112 and 113 are controlled by a current limiting circuit 121. The other portions are the same as those of the embodiment shown in FIG. 16.

Figure 18:
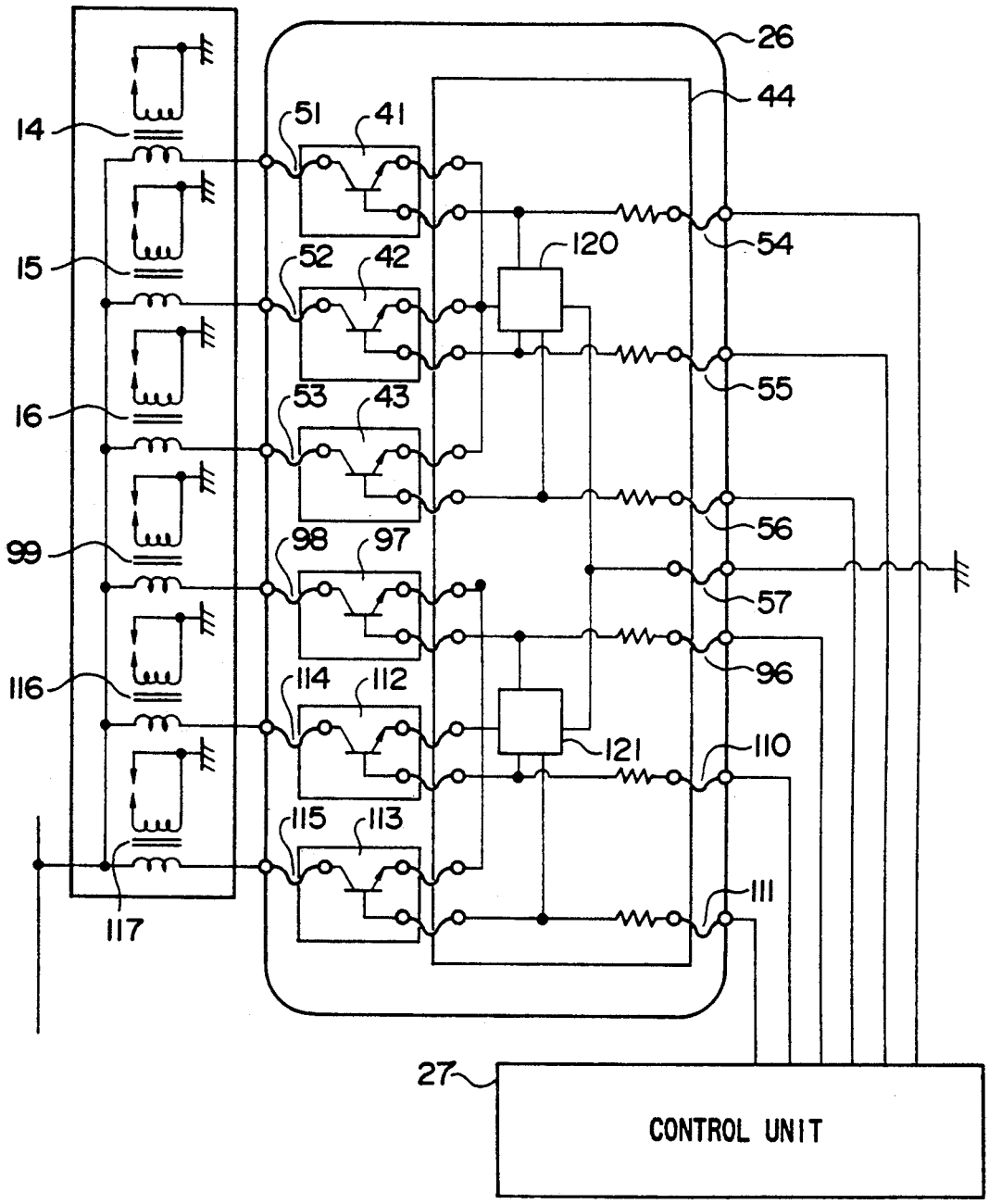
FIG. 18 is a diagram for showing an embodiment in which two current detecting portions are provided in a six-cylinder independent firing system.

A still another embodiment of the present invention will be explained with reference to FIG. 18. In this embodiment, a so-called six-cylinder independent firing system, having one ignition plug connected to each of the six ignition coils 14, 15, 16, 99, 116 and 117, is shown. The other portions are the same as those of the embodiment shown in FIG. 17.

Figure 19:
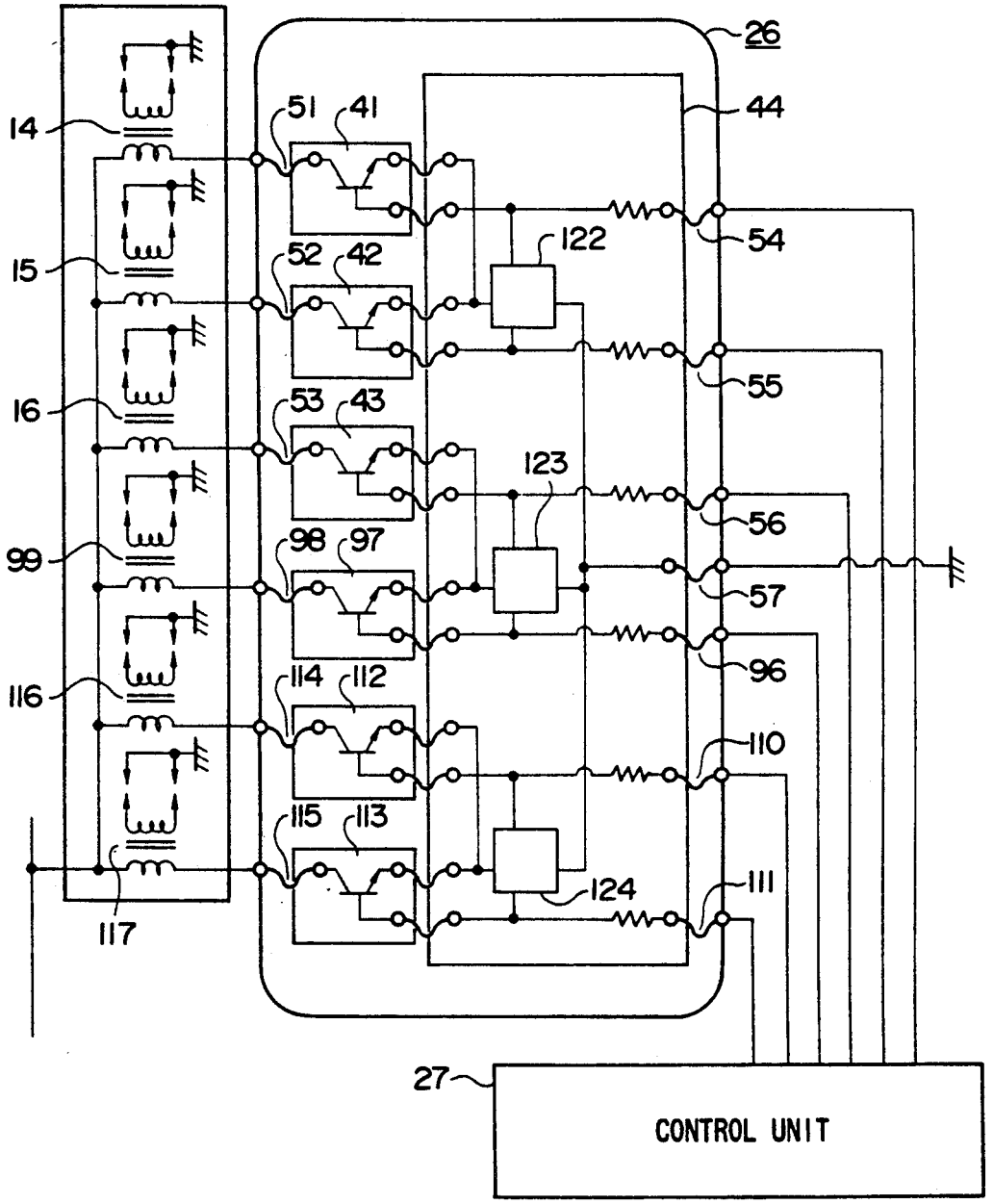
FIG. 19 is a diagram for showing an embodiment in which three current detecting portions are provided in a twelve-cylinder simultaneous firing system.

A still another embodiment of the present invention will be explained with reference to FIG. 19. In this embodiment, the currents flowing to the power transistors 41 and 42 are controlled by a current limiting circuit 122, the currents flowing to the power transistors 43 and 97 are controlled by a current limiting circuit 123 and the currents flowing to the power transistors 112 and 113 are controlled by a current limiting circuit 124. The other portions are the same as those of the embodiment shown in FIG. 15.

Figure 20:
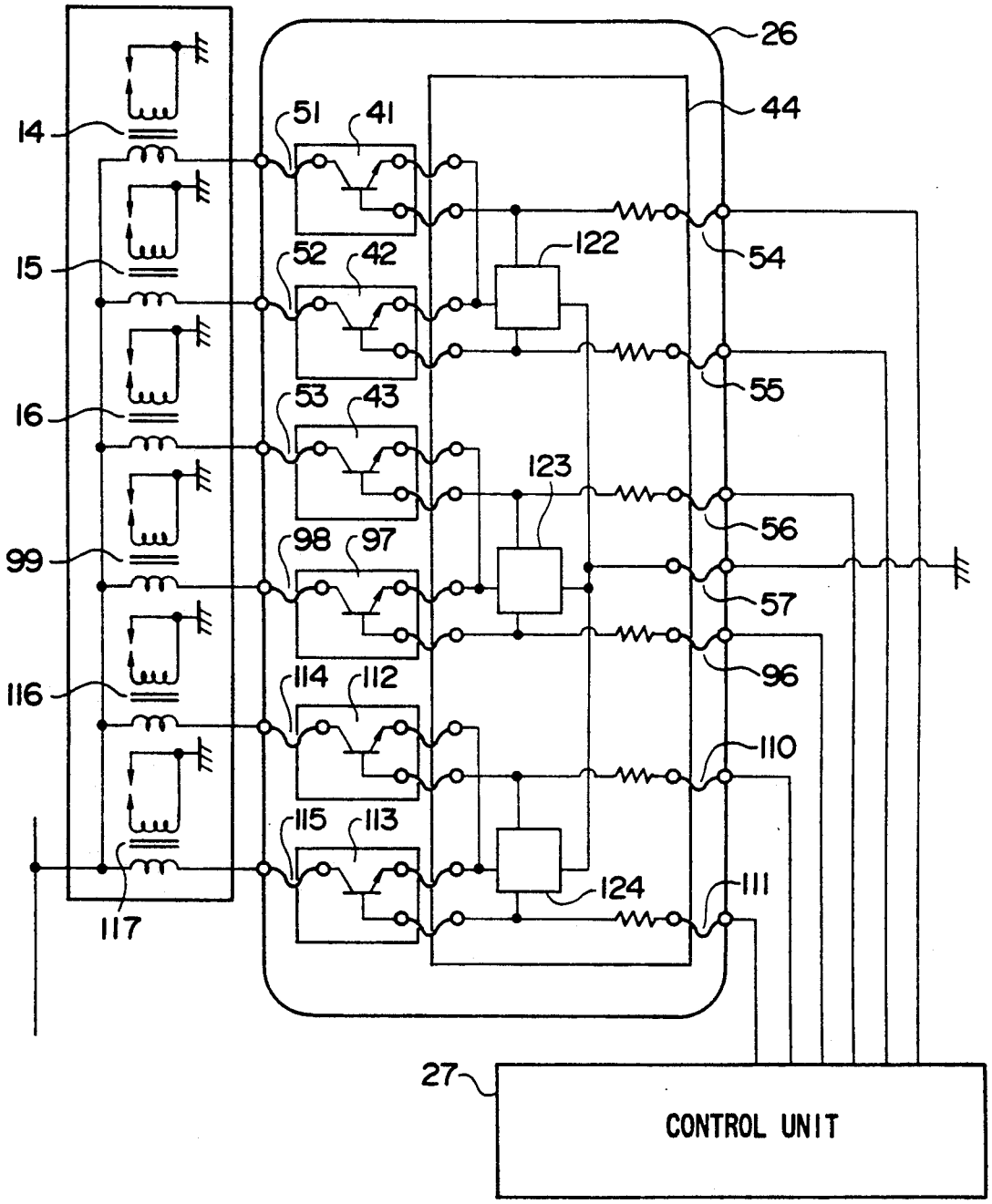
FIG. 20 is a diagram for showing an embodiment in which three current detecting portions are provided in a six-cylinder independent firing system.

A still another embodiment of the present invention will be explained with reference to FIG. 20. In this embodiment, a so-called six-cylinder independent firing system, having one ignition plug connected to each of the six ignition coils 14, 15, 16, 99, 116 and 117, is shown. The other portions are the same as those of the embodiment shown in FIG. 18.

Figure 21:
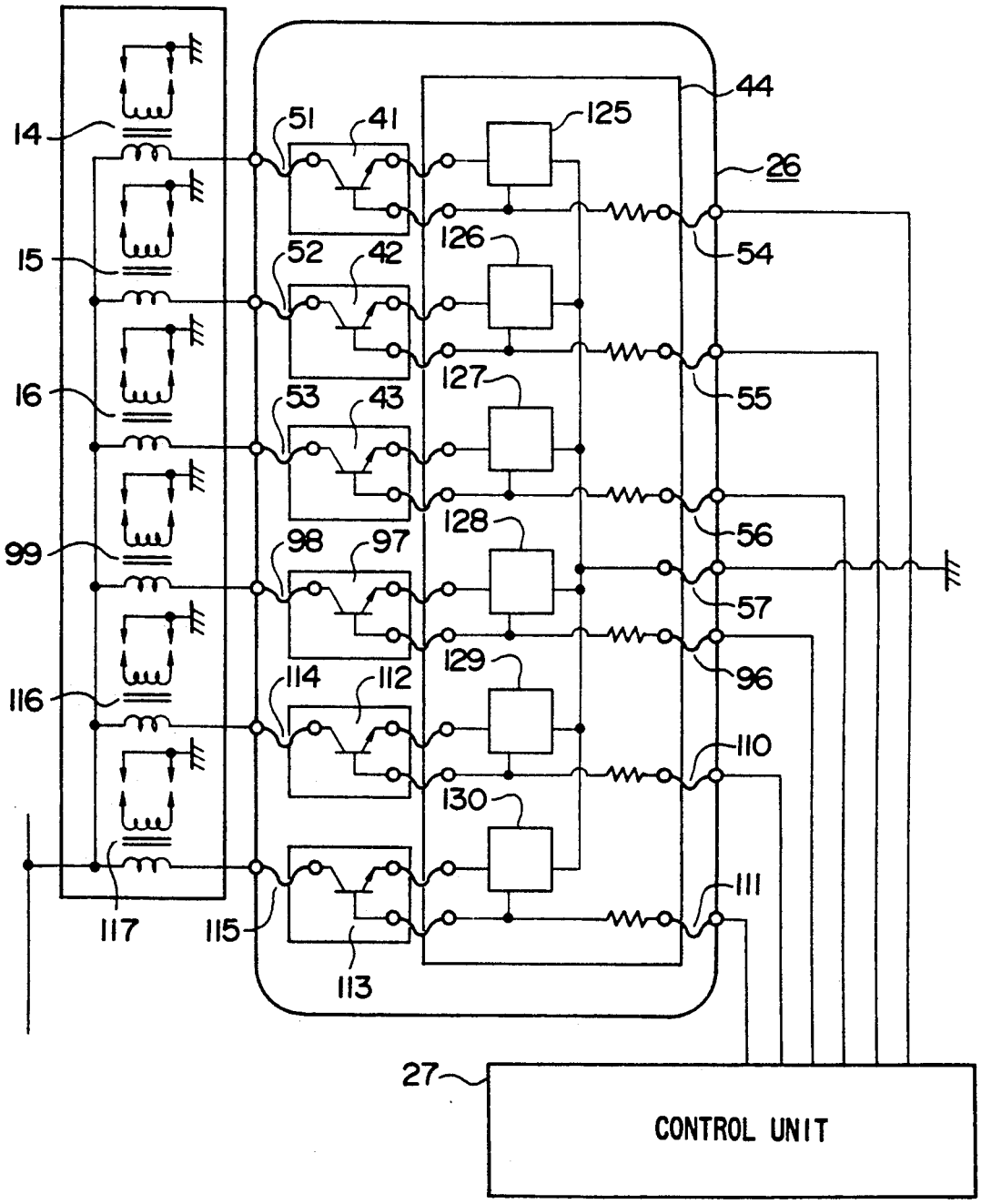
FIG. 21 is a diagram for showing an embodiment in which six current detecting portions are provided in a twelve-cylinder simultaneous firing system.

A still another embodiment of the present invention will be explained with reference to FIG. 21. In this embodiment, the currents flowing to the power transistors 41, 42, 43, 97, 112 and 113 are controlled by current limiting circuits 125, 126, 127, 128, 129 and 130 respectively. The other portions are the same as those of the embodiment shown in FIG. 15.

Figure 22:
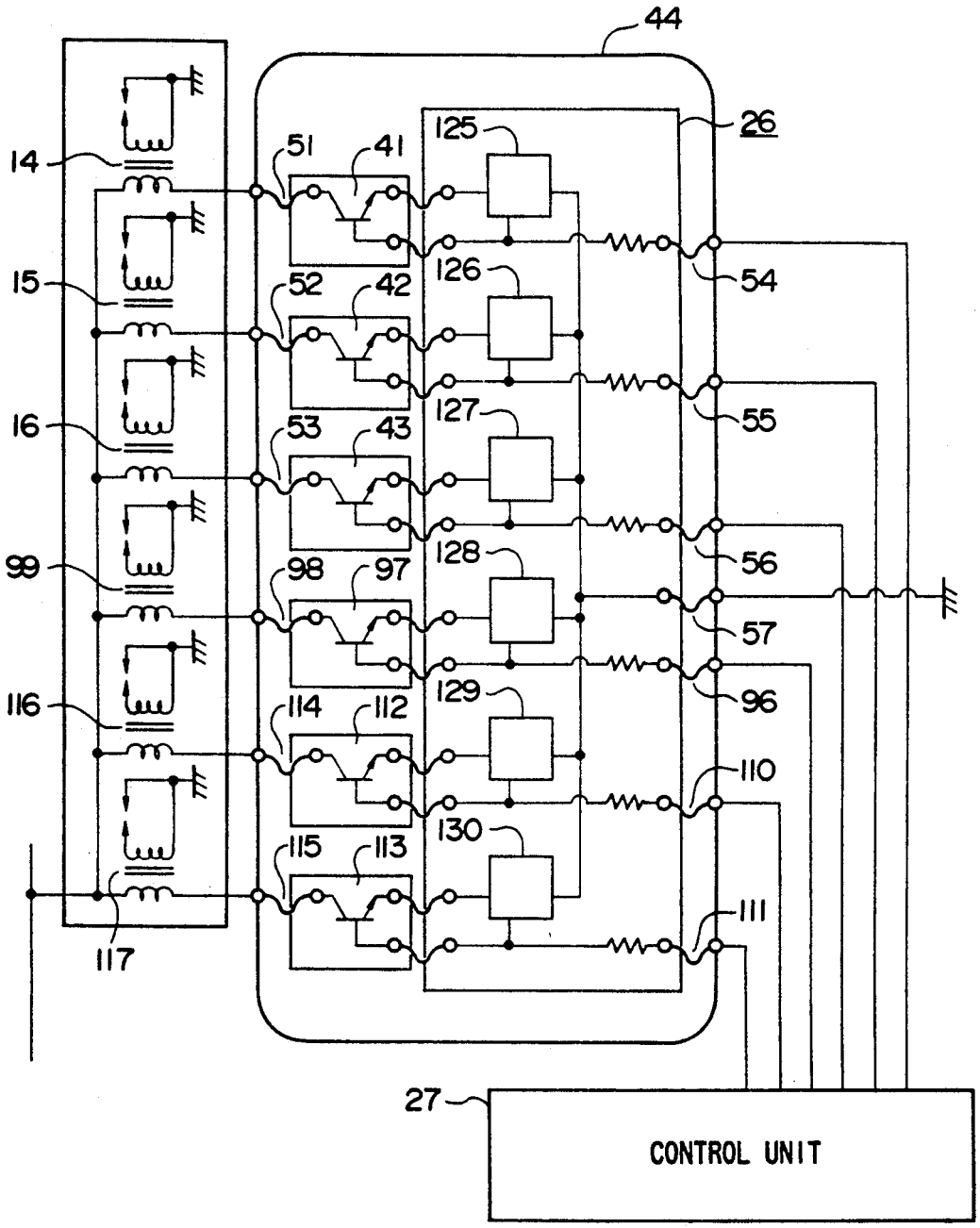
FIG. 22 is a diagram for showing an embodiment in which six current detecting portions are provided in a six-cylinder independent firing system.

A still another embodiment of the present invention will be explained with reference to FIG. 22. In this embodiment, a so-called six-cylinder independent firing system, having one ignition plug connected to each of the six ignition coils 14, 15, 16, 99, 116 and 117, is shown. The other portions are the same as those of the embodiment shown in FIG. 21.

Figure 10:
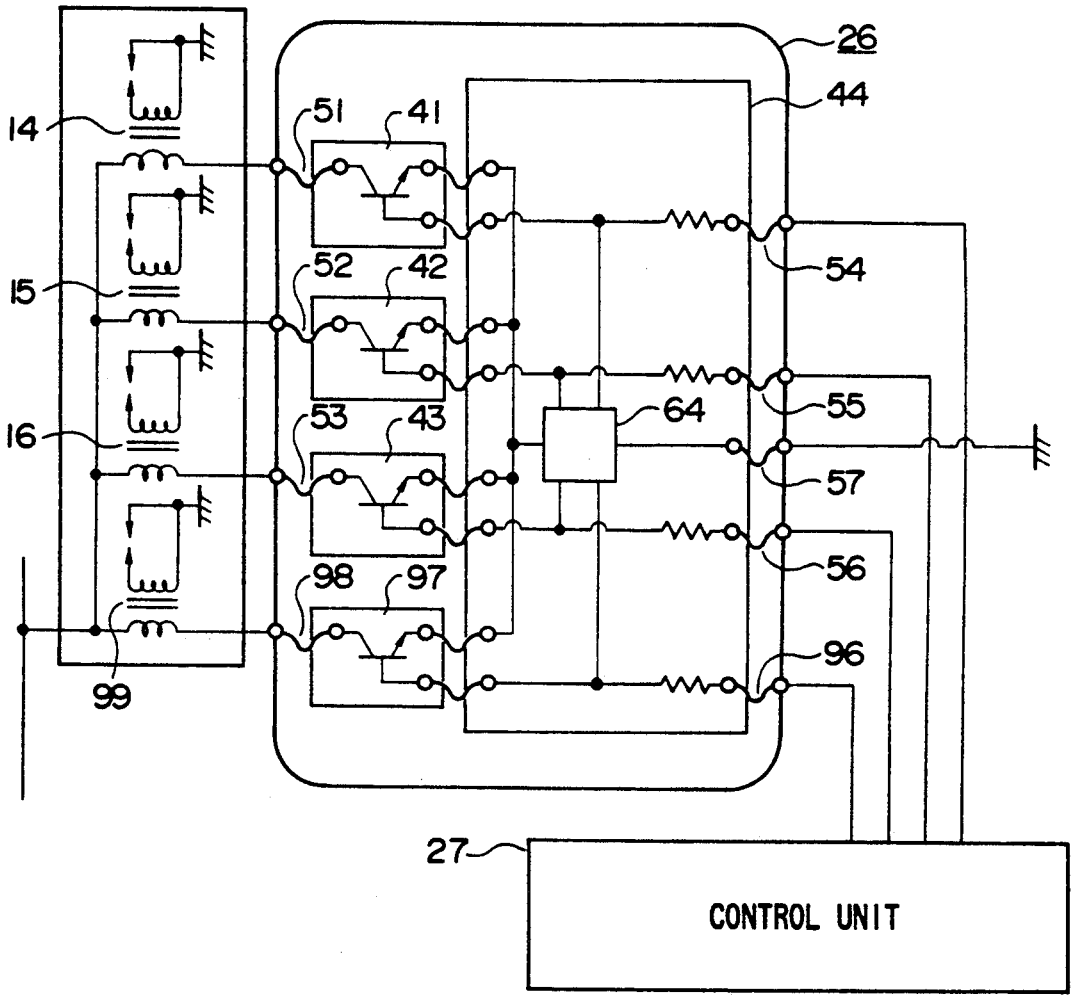
FIG. 10 is a diagram for showing an embodiment in which one current detecting portion is provided in a four-cylinder independent firing system.
Figure 12:
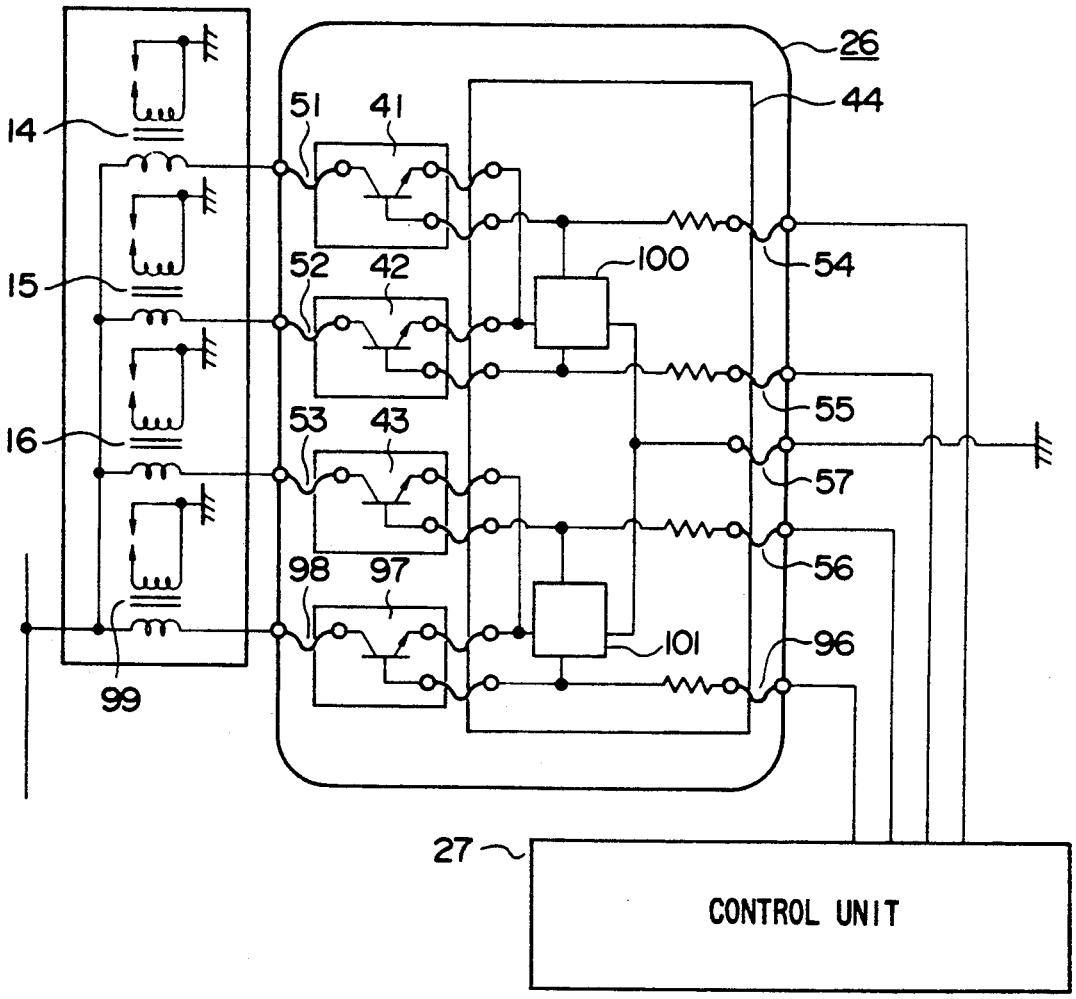
FIG. 12 is a diagram for showing an embodiment in which two current detecting portions are provided in a four-cylinder independent firing system.
Figure 13:
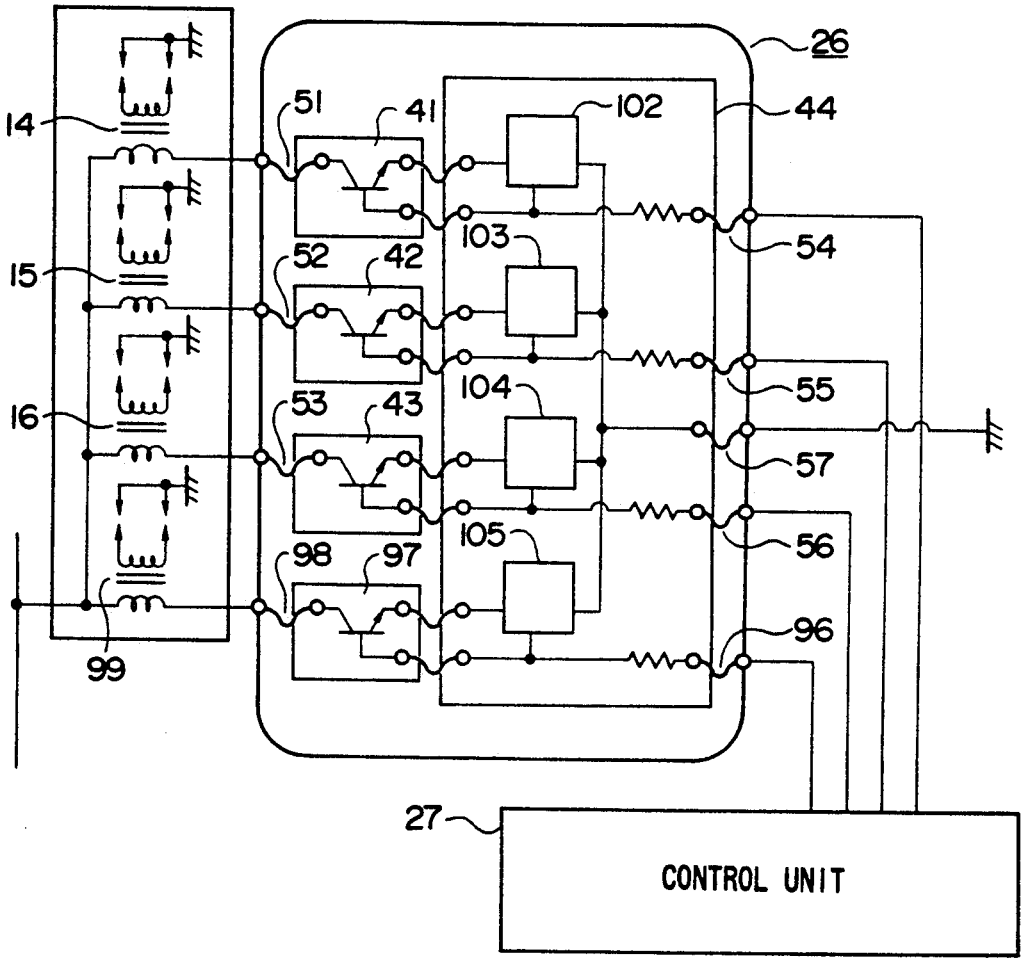
FIG. 13 is a diagram for showing an embodiment in which four current detecting portions are provided in an eight-cylinder simultaneous firing system.
Figure 14:
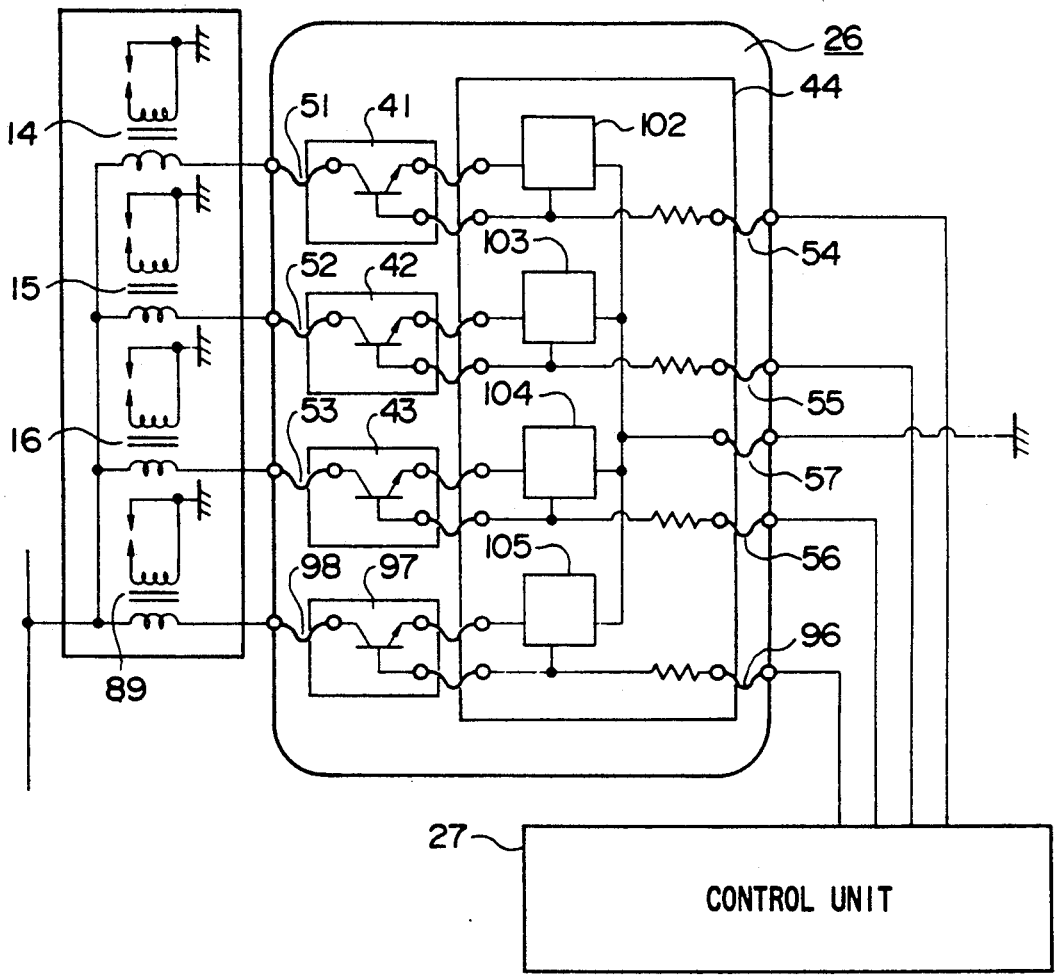
FIG. 14 is a diagram for showing an embodiment in which four current detecting portions are provided in a four-cylinder independent firing system.

In the above-described embodiments shown in FIGS. 10, 12 and 14, an eight-cylinder independent firing system for connecting two ignition plugs to each ignition coil may also be used. Further, in the above-described embodiments shown in FIGS. 16, 18, 20 and 22, a twelve-cylinder simultaneous firing system for connecting two ignition plugs to each ignition coil may also be used.

As described above, in each of the embodiments shown in FIGS. 1 to 22, the resistance values of the lead frames 51 to 53 (the lead frames at the ignition side) have been set to be larger than the resistance value of the lead frame 57 (the lead frame at the earth side), to solve problems encountered when the power transistors 41 to 43 are short-circuited on the above embodiments, the following configuration may also be used. Explanation of the portions which are the same as those of each embodiment shown in FIGS. 1 to 22 will be omitted. Therefore, portions for which no explanation is made below are, in principle, the same as those portions of each embodiment shown in FIGS. 1 to 22.

First, by setting the melting point of the lead frames 51 to 53 at the ignition coil side to be lower than the melting point of the lead frame 57 at the earth side, almost the same effects as that of the above-described embodiments can be obtained. For example, it is good to use lead frames made of aluminum (the melting point: 660.4° C.) for the lead frames 51 to 53 at the ignition coil side and use a lead frame made of copper (the melting point: 1084.5° C.) for the lead frame 57 at the earth side.

Then, by connecting the lead frames 51 to 53 at the ignition coil side with solder, almost the same effects as those of the above-described embodiments can be obtained. In other words, it is good to connect the package terminals 71 to 73 with the lead frames 51 to 53 at the ignition coil side by using eutectic solder (Components: tin 40%, lead 60%; melting point: 183° C.) or to connect the lead frames 51 to 53 at the ignition coil side with the ceramic substrate 82 by using eutectic solder. In this case, the connection of the lead frame 57 at the earth side is carried out by using high temperature solder (component: tin 10%, lead 90%; melting point: 320° C.) or by welding. When the power transistors 41 to 43 are short-circuited to have a continued conductive state, the current flowing to the lead frame at the ignition side (the corresponding one of the lead frames 51 to 53) and the current flowing to the lead frame 57 at the earth side become higher levels and these lead frames are heated. The temperature of the lead frame at the ignition side (one of the lead frames 51 to 53 corresponding to the short-circuited power transistor) and the temperature of the lead frame 57 at the earth side rise respectively. However, since the lead frames 51 to 53 at the ignition coil side are connected by the eutectic solder, the eutectic solder is melted earlier when its temperature has reached a relatively low temperature (183° C.), so that the connection between the ignition coils 14 to 16 corresponding to the short-circuited power transistor and the short-circuited power transistor (one of the power transistors 41 to 43) is released. In this case, it is desirable to arrange such that a spring force is generated in the lead frames 51 to 53 at the ignition coil side. With this arrangement, when the eutectic solder is melted the lead frames 51 to 53 at the ignition coil side are elasticly deformed and the connection of the lead frames 51 to 53 at the ignition coil side is released with high reliability.

Figure 23:
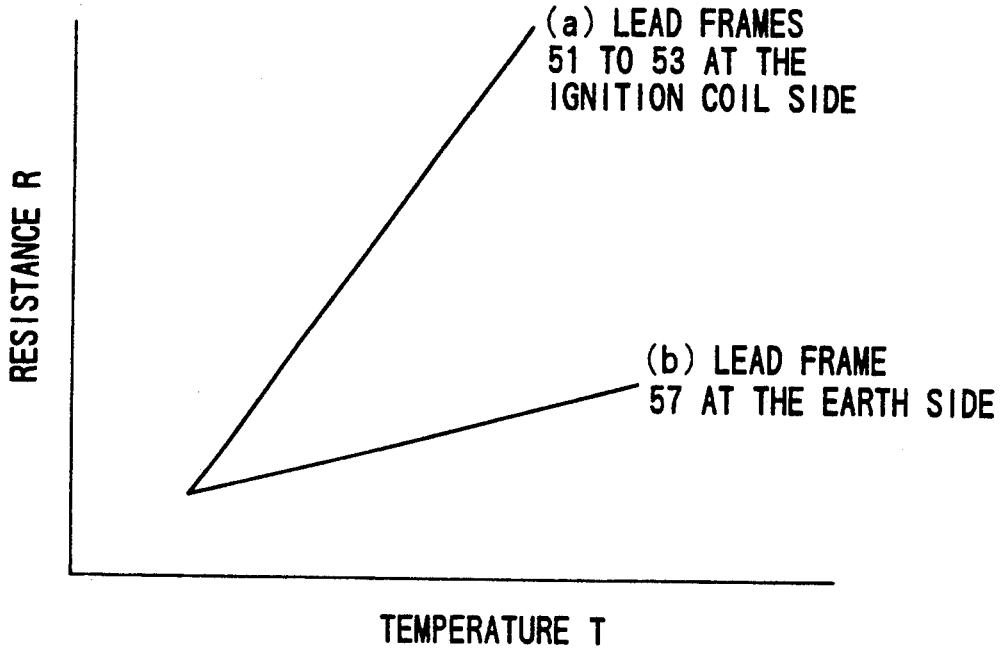
FIG. 23 is a diagram for showing changes of resistance versus changes of temperature for the lead frame at the ignition side and the lead frame at the earth side respectively.

Further, it is also possible to obtain almost the same effects as those of the above-described embodiments if the temperature coefficient of the specific resistivity of the lead frames 51 to 53 at the ignition coil side is set at a level higher than the temperature coefficient of the specific resistivity of the lead frame 57 at the earth side. The example, it is desirable to use the lead frames 51 to 53 at the ignition coil side which have the characteristics as shown in (a) in FIG. 23 and to use the lead frame 57 at the earth side which has the characteristics as shown in (b) in FIG. 22. When the power transistors 41 to 43 are short-circuited to have an open state continuously, the current level of the lead frame at the ignition side (any one of the lead frames 51 to 53 corresponding to the short-circuited power transistor) and the current level of the lead frame 57 at the earth side become higher respectively so that these lead frames are heated. With this heating, the resistance value of the lead frame at the ignition coil side (one of the lead frames 51 to 53) and the resistance value of the lead frame 57 at the earth side become larger. However, since the temperature coefficient of the specific resistivity of the lead frames 51 to 53 at the ignition coil side is higher than the temperature coefficient of the specific resistivity of the lead frame 57 at the earth side, the resistance value of the lead frames 51 to 53 at the ignition coil side increases suddenly, so that the calorific value increases suddenly as well. Because of such a synergistic effect as described above, the temperature of the lead frame at the ignition coil side (one of the lead frames 51 to 53) rises suddenly, so that the lead frame at the ignition coil side corresponding to the short-circuited power transistor is fused earlier than the lead frame 57 at the earth side.

Figure 24:
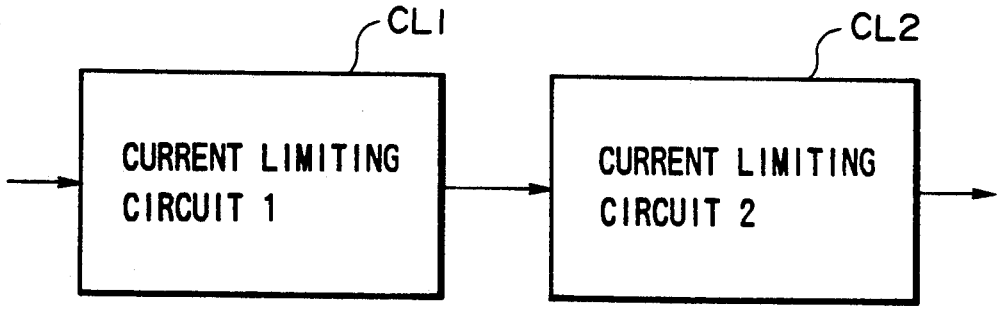
FIG. 24 is a block circuit diagram for showing a separate embodiment of the current limiting circuit.

FIG. 24 shows another embodiment of the current limiting circuit according to the present invention. Two current limiting circuits $CL_1$ and $CL_2$ of different current limiting capacities are connected in series. This embodiment corresponds to the above-described embodiment having the fifth configuration. According to this embodiment, even if one of the two current limiting circuits $CL_1$ and $CL_2$ gets in a fault, the other current limiting circuit which is connected in series with the faulty current limiting circuit can back up the operation.

As described above, according to the first to the fourth configurations of the present invention, even if one of a plurality of switching elements has been fixed to a conductive state, it is possible to control the currents which flow to the ignition coils connected to the other switching elements that function normally. According to the fifth configuration of the present invention, even if the current limiting circuit has come not to function sufficiently, it is possible to prevent an excess current from flowing to the ignition coils and to restrict the heating of the ignition coils. Further, according to the sixth configuration of the present invention, even if the current level of the current flowing to one of the switching elements connected to a common current detecting resistor has become equal to or higher than a predetermined level, it is possible to control the currents which flow to the ignition coils connected to the other switching elements.

We claim:

1. A distributor for an internal combustion engine which separately conducts and breaks by a plurality of switching elements, a current flowing from a battery of a plurality of ignition coils, combines the currents from the plurality of switching elements at a junction point and connects the current from the junction point to the earth, characterized in that the distributor further has current limiting means for limiting the current when any one of the plurality of switching elements has become not possible to break and this current limiting means is disposed at a position between the battery and the junction point.

2. A distributor for an internal combustion engine which separately conducts and breaks by a plurality of switching elements, a current flowing from a battery to a plurality of ignition coils, combines the currents from the plurality of switching elements at a junction point and connects the current from the junction point to the earth, characterized in that when any one of the plurality of switching elements has become not possible to break, any one of the portions of a conductor at a position between the battery and the junction point is broken, among conductors through which a current has been flowing to the switching element that has become not possible to break.

3. An igniting apparatus for an internal combustion engine having a switching element for conducting and breaking a current which flows to an ignition coil and first current limiting means for limiting the current flowing to the switching element when a current level of the current flowing to the switching element has become larger than a first predetermined value, characterized in that the igniting apparatus further has second current limiting means for limiting a current flowing to the switching element when a current level of the current which has flown to the switching element is larger than a second predetermined value, the second predetermined value having been set to be larger than the first predetermined value.

4. An electronic device for controlling a load, having first current limiting means for controlling a current flowing to an electrical lead when a current level of the current flowing to the electrical load has become larger than a first predetermined value, characterized in that the electronic device has second current limiting means for controlling a current flowing to the electrical load when a current level of the current which has flown to the electrical load is larger than a second predetermined value, the second predetermined value having been set to be larger than the first predetermined value.

5. An electronic device for controlling a load, which separately conducts and breaks by a plurality of switching elements, a current plowing from a first electric potential to a plurality of electrical loads, combines the currents from the plurality of switching elements at a junction point and flows the current of the junction point to a second electric potential, characterized in that the electronic device has current limiting means which, when one of the plurality of switching elements has become not possible to break, limits the current flowing to the switching elements which has become not possible to break, the current limiting means having been disposed at a position between the first electric potential and the junction point.

6. An electronic device for controlling a load, which separately conducts and breaks by a plurality of switching elements a current flowing from a first electric potential to a plurality of electrical loads, combines the currents from the plurality of switching elements at a junction point and flows the current of the junction point to a second electric potential, characterized in that when one of the plurality of switching elements has become not possible to break, one of the portions of a conductor from the first electric potential to the junction point is broken, among conductors through which a current has been flown to the switching element which has become not possible to break.

7. An ignition timing controlling apparatus for an internal combustion engine, having a plurality of switching elements for separately conducting and having currents flowing to a plurality of ignition coils, a control unit for controlling the state of switching of the plurality of switching elements, a plurality of first lead frames for separately flowing the currents plurality of ignition coils and a second single lead frame for dropping a current level of the currents of at least two switching elements of the plurality of switching elements to a common electric potential, characterized in that the resistance values of the first lead frames have been set to be higher than the resistance value of the second lead frame.

8. An electronic distributor for an internal combustion engine, having a plurality of switching elements for separately conducting and breaking currents flowing to a plurality of ignition coils, a plurality of first lead frames for separately flowing currents of the plurality of switching elements to the plurality of ignition coils and a second single lead frame for dropping current levels of the currents of at least two switching elements of the plurality of switching elements to a common electric potential, characterized in that the temperature coefficient of the specific resistivity of the first lead frames has been set to be larger than the temperature coefficient of the specific resistivity of the second lead frame.

9. An electric distributor for an internal combustion engine, having a plurality of switching elements for separately conducting and breaking currents flowing to a plurality of ignition coils, a plurality of first lead frames for separately flowing currents of the plurality of switching elements to the plurality of ignition coils and a second single lead frame for dropping current levels of the currents of at least two switching elements of the plurality of switching elements to a common electric potential, characterized in that the melting point of the second lead frame has been set to be lower than the melting point of the first lead frames.

10. An electronic distributor for an internal combustion engine, having a plurality of switching elements for separately conducting and breaking currents flowing to a plurality of ignition coils and first current limiting means for controlling the currents flowing to the switching elements when current levels of the currents flowing to the switching elements have become larger than a predetermined value, characterized in that the electronic distributor further has second current limiting means for limiting current flowing to the switching elements when current levels of the currents flown to the switching elements are larger than a second predetermined level and that the second predetermined value has been set to be larger than the first predetermined value.

11. An electronic distributor for an internal combustion engine, having a plurality of switching elements for separately conducting and breaking currents flowing to a plurality of ignition coils, a common current detecting resistor to which the currents flowing to the plurality of switching elements flow and a current limiting circuit for simultaneously breaking the currents flowing to the plurality of switching elements when current levels of the currents flowing to the current detecting resistor have exceeded a predetermined value, characterized in that a resistance value of a conductor for electrically connecting the ignition coil with the current detecting resistor has been set to be higher than a resistance value of a conductor for electrically connecting the current detecting resistor with the earth.

12. An electronic distributor for an internal combustion engine, having a plurality of switching elements for separately conducting and breaking currents flowing to a plurality of ignition coils and a common electric potential to which currents of at least two switching elements of the plurality of switching elements flow, characterized in that a resistance value of a conductor for connecting the ignition coils with the switching elements has been set to be higher than a resistance value of a conductor to which the currents flowing to the plurality of switching elements flow, among conductors for connecting the plurality of switching elements with the common electric potential.

13. An electronic distributor for an internal combustion engine, having a plurality of switching elements for conducting and breaking currents flowing to a plurality of ignition coils, a first lead frame for separately flowing the currents of the plurality of switching elements to the plurality of ignition coils and a second lead frame for dropping current levels of currents of at least two switching elements of the plurality of switching elements to a common electric potential, characterized in that materials of both the first and second lead frames are substantially the same and that the length of each of the first lead frames has been set to be larger than the length of the second lead frame so that a resistance value of the first lead frames is set to be larger than a resistance value of the second lead frame.

14. An electronic distributor for an internal combustion engine, having a plurality of switching elements for conducting and breaking currents flowing to a plurality of ignition coils, a first lead frame for separately flowing the currents of the plurality of switching elements to the plurality of ignition coils and a second lead frame for dropping current levels of currents of at least two switching elements of the plurality of switching elements to a common electric potential, characterized in that materials of both the first and second lead frames are substantially the same and that the cross section of each of the first lead frames has been taken to be smaller than the cross section of the second lead frame so that a resistance value of the first lead frames is set to be larger than a resistance value of the second lead frame.

15. An electronic distributor for an internal combustion engine, having a plurality of switching elements for separately conducting and breaking currents flowing to a plurality of ignition coils, a plurality of first lead frames for separately flowing currents of the plurality of switching elements to the plurality of ignition coils and a second single lead frame for dropping current levels of the currents of at least two switching elements of the plurality of switching elements to a common electric potential, characterized in that at least one of both ends of each of the first lead frames is connected by solder and that the solder is melted to release the electrical connection of one of the first lead frames when a current level of the current flowing to the first lead frame concerned has exceeded a predetermined current level.

16. An electronic distributor for an internal combustion engine according to claim 15, characterized in that the first lead frame of which solder is melted is elastically deformed after the solder has been melted.

17. An electronic distributor for an internal combustion engine, having a plurality of switching elements for separately conducting and breaking currents flowing to a plurality of ignition coils, a plurality of first lead frames for separately flowing currents of the plurality of switching elements to the plurality of ignition coils and a second single lead frame for dropping current levels of the currents at least two switching elements of the plurality of switching elements to a common electric potential, characterized in that the resistance values of the first lead frames have been set to be higher than the resistance value of the second lead frame.

18. An electronic distributor for an internal combustion engine according to claim 17, characterized in that the first lead frames have been set to be longer than the second lead frame.

19. An electronic distribution for an internal combustion engine according to claim 17, characterized in that the first lead frames have been set to be thinner than the second lead frame.

20. An electronic distributor for an internal combustion engine according to claim 17, characterized in that the number of the second lead frames structured is larger than the number of the first lead frames structured.

21. An electronic distributor for an internal combustion engine according to claim 17, characterized in that the switching elements are disposed on a metal base and the second lead frame is connected to the metal base.

22. An electronic distributor for an internal combustion engine according to claim 17, characterized in that the material of the first lead frames has been differentiated from the material of the second lead frame.

23. An electronic distributor for an internal combustion engine according to claim 22, characterized in that a nickel or iron nickel material has been used for the first lead frames and copper or pyrites has been used for the second lead frame.

* * * * *